US007819143B2

(12) United States Patent
Nagaoka et al.

(10) Patent No.: US 7,819,143 B2
(45) Date of Patent: Oct. 26, 2010

(54) REINFORCING BAR BINDER, WIRE REEL AND METHOD FOR IDENTIFYING WIRE REEL

(75) Inventors: Takahiro Nagaoka, Tokyo (JP); Ichiro Kusakari, Tokyo (JP)

(73) Assignee: Max Kabushiki Kaisha, Tokyo (JP)

( * ) Notice: Subject to any disclaimer, the term of this patent is extended or adjusted under 35 U.S.C. 154(b) by 293 days.

(21) Appl. No.: 10/550,595

(22) PCT Filed: Nov. 8, 2004

(86) PCT No.: PCT/JP2004/016922

§ 371 (c)(1),
(2), (4) Date: Jun. 22, 2006

(87) PCT Pub. No.: WO2005/066435

PCT Pub. Date: Jul. 21, 2005

(65) Prior Publication Data

US 2006/0283516 A1 Dec. 21, 2006

(30) Foreign Application Priority Data

Jan. 9, 2004 (JP) ..... 2004-004816

(51) Int. Cl.

| | |
|---|---|
| ***B21F 33/00*** | (2006.01) |
| ***B21F 15/04*** | (2006.01) |
| ***B65H 26/00*** | (2006.01) |
| ***B65H 75/14*** | (2006.01) |
| ***G01B 5/24*** | (2006.01) |
| ***G01B 7/30*** | (2006.01) |
| ***G06F 19/00*** | (2006.01) |

(52) U.S. Cl. ..... 140/57; 140/119; 242/563; 242/614; 242/912; 33/1 PT; 700/122; 700/126

(58) Field of Classification Search ..... 242/563, 242/563.2, 588.6, 601, 912, 913, 614; 72/37; 140/57, 93.2, 93.6, 93 A, 119, 149; 700/122, 700/126; 33/707, 1 N, 1 PT; 356/343, 411
See application file for complete search history.

(56) References Cited

U.S. PATENT DOCUMENTS 4,244,539 A * 1/1981 Taneda et al. ..... 242/478.1

(Continued)

FOREIGN PATENT DOCUMENTS

EP 0 751 270 A1 1/1997

(Continued)

OTHER PUBLICATIONS

European Search Report issued in a corresponding application.

(Continued)

*Primary Examiner*—Teresa M Bonk
(74) *Attorney, Agent, or Firm*—Buchanan Ingersoll & Rooney PC

(57) ABSTRACT

A reinforcing bar binder capable of certainly identifying the type of a wire reel and automatically adjusting the amount of feeding of the wire wound around the wire reel or the twisting torque on the wire is provided. The reinforcing bar binder feeds a wire while rotating a wire reel mounted in a storing chamber and binds a reinforcing bar. The storing chamber is provided with a first detecting means for detecting the amount of rotation of the wire reel and a second detecting means for detecting the number of second to-be detecting portions on the wire reel during the amount of rotation detected by the first detecting means. The binder main body is provided with controlling means for controlling the amount of feeding of the wire or the twisting torque on the wire based on the basis of the number of the second to-be-detected portions detected by the second detecting means.

10 Claims, 19 Drawing Sheets

U.S. PATENT DOCUMENTS

| | | | | |
|---|---|---|---|---|
| 5,129,725 | A * | 7/1992 | Ishizuka et al. | 356/617 |
| 5,515,887 | A * | 5/1996 | Hanagasaki et al. | 140/119 |
| 5,678,613 | A | 10/1997 | Murayama et al. | |
| 5,874,816 | A | 2/1999 | Ishii | |
| 5,938,196 | A | 8/1999 | Antoja | |
| 5,983,473 | A | 11/1999 | Yuguchi et al. | |
| 5,990,919 | A | 11/1999 | Bobb et al. | |
| 6,338,263 | B1 * | 1/2002 | Obata et al. | 72/105 |
| 6,401,766 | B1 * | 6/2002 | Ishikawa et al. | 140/57 |
| 7,147,179 | B2 | 12/2006 | Nakagawa et al. | |
| 2003/0226928 | A1 * | 12/2003 | McNeil et al. | 242/413.2 |
| 2005/0077413 | A1 | 4/2005 | Nakagawa et al. | |
| 2009/0126824 | A1 | 5/2009 | Nakagawa et al. | |

FOREIGN PATENT DOCUMENTS

| | | | |
|---|---|---|---|
| EP | 0 822 303 | A1 | 2/1998 |
| EP | 1 430 971 | | 6/2004 |
| JP | 06-190482 | A | 7/1994 |
| JP | 06-226386 | A | 8/1994 |
| JP | 09-076543 | A | 3/1997 |
| JP | 9-165918 | | 6/1997 |
| JP | 2557192 | | 8/1997 |
| JP | 9-250205 | A | 9/1997 |
| JP | 2557192 | Y2 | 12/1997 |
| JP | 10-045105 | A | 2/1998 |
| JP | 10-150890 | | 6/1998 |
| JP | 10-249469 | A | 9/1998 |
| JP | 11-104777 | A | 4/1999 |
| JP | 11-156748 | A | 6/1999 |
| JP | 2001-038647 | A | 2/2001 |
| JP | 2002-225813 | A | 8/2002 |
| SU | 1687673 | | 10/1991 |
| WO | WO 03/028916 | | 7/2003 |

OTHER PUBLICATIONS

Non-Final Office Action in Copending U.S. Appl. No. 12/269,283 to Yasushi Nakagawa et al. dated Apr. 27, 2009.

European Search Report dated May 18, 2010 issued in European Patent Application No. 10 15 2610.

* cited by examiner (a)

(b)

(c)

(a)

(b)

(c)

(a)

(c)

(b)

REINFORCING BAR BINDER, WIRE REEL AND METHOD FOR IDENTIFYING WIRE REEL

CROSS-REFERENCE TO RELATED APPLICATIONS

This application is a national stage application of PCT/JP04/16922 filed Nov. 8, 2004, which claims priority from Japanese application 2004-004816 filed on Jan. 9, 2004, which is incorporated herein by reference in its entirety.

TECHNICAL FIELD

The present invention relates to a reinforcing bar binder capable of identifying the type of a wire reel and automatically adjusting the amount of feeding of a wire wound around the wire reel or the twisting torque on the wire, a wire reel used therewith and a method for identifying a wire reel.

BACKGROUND ART

In a conventional reinforcing bar binder, a wire reel around which a wire is wound is retained at the rear portion thereof and, when the switch is turned on and a trigger is manipulated, the wire is drawn out and fed forward from the wire reel through a wire feeding device, discharged in a loop shape from the tip end curved portion of a guide arm and wound onto a reinforcing bar and, thereafter, a twisting hook grips a portion of the loop and torsionally rotates to bind the reinforcing bar. As a configuration for automatically adjusting the wire twisting torque of such a reinforcing bar binder, there has been a configuration which provides displaying means for displaying the type of a wire on the side surface of a wire reel, employs detecting means provided on the reinforcing bar binder for detecting the displaying means, identifies the type of the wire on the basis of the result of detection from the detecting means and automatically adjusts the twisting torque, as disclosed in JP-B No. 3050369.

A conventional reinforcing bar binder employs reflective stickers as the displaying means and a plurality of photo sensors as the detecting means so that any of the plural sensors can detect the reflective stickers provided on the side surface of the wire reel to detect the type of the wire reel. However, such a reinforcing bar binder requires plural photo sensors, thus involving a complicated and expensive construction. Furthermore, the reflective stickers may be detected by photo sensors other than the photo sensors used for detecting the reflective stickers, due to the rotation speed of the wire reel and external disturbing light and the like, which has caused malfunctions in some cases.

The present invention was made in view of the aforementioned problems. It is a first object of the present invention to provide a reinforcing bar binder capable of certainly identifying the type of a wire reel and automatically adjusting the amount of feeding of the wire wound around the wire reel or the twisting torque on the wire while having a simple and inexpensive construction. Further, it is a second object to provide a wire reel used with the reinforcing bar binder. Further, it is a third object to provide a method for certainly identifying a wire reel.

DISCLOSURE OF THE INVENTION

For achieving the aforementioned first object, a reinforcing bar binder according to a first aspect of the present application is a reinforcing bar binder including a storing chamber which is provided in a binder main body and mounts a wire reel around which a reinforcing-bar binding wire is wound to wind said wire around a reinforcing bar and then to twist said wire for binding of said reinforcing bar, wherein the storing chamber is provided with a first detecting means for detecting the amount of rotation of the wire reel and a second detecting means for detecting the number of second to-be-detected portions on the wire reel.

For achieving the aforementioned first object, a reinforcing bar binder according to a second aspect of the present application is a reinforcing bar binder including a storing chamber which is provided in a binder main body and mounts a wire reel around which a reinforcing-bar binding wire is wound to wind said wire around a reinforcing bar and then to twist said wire for binding of said reinforcing bar while rotating said wire reel to feed said wire, wherein the storing chamber is provided with a first detecting means for detecting the amount of rotation of said wire reel and a second detecting means for detecting the number of second to-be-detected portions on the wire reel during the amount of rotation detected by the first detecting means; and the binder main body is provided with controlling means for controlling the amount of feeding of the wire or the twisting torque on the wire depending on the number of the second to-be-detected portions detected by the second detecting means.

For achieving the aforementioned first object, in the reinforcing bar binder according to a third aspect of the present application, the first detecting means detects first to-be-detected portions on the wire reel to detect the amount of rotation of the wire reel.

For achieving the aforementioned first object, in the reinforcing bar binder according to a fourth aspect of the present application, the first detecting means is a contact-type sensor and the first to-be-detected portions are convex portions or concave portions which are detected by the contact-type sensor while the second detecting means is a non-contact type sensor and the second to-be-detected portions are marks which are detected by the non-contact type sensor.

For achieving the aforementioned second object, a wire reel according to a fifth aspect of the present application is a wire reel used in a reinforcing bar binder including a storing chamber which is provided in a binder main body and mounts a wire reel around which a reinforcing-bar binding wire is wound to wind said wire around a reinforcing bar and then to twist said wire for binding of said reinforcing bar, wherein the reel main body is provided with first to-be-detected portions which are detected by a first detecting means in the reinforcing bar binder and second to-be-detected portions which are detected by a second detecting means in the reinforcing bar binder For achieving the aforementioned second object, in the wire reel according to a sixth aspect of the present application, the first to-be-detected portions are detected by the first detecting means to detect the amount of rotation of the wire reel and the second to-be-detected portions are detected by the second detecting means to identify the type of the wire reel.

For achieving the aforementioned second object, in the wire reel according to a seventh aspect of the present application, the first detecting means is a contact-type sensor and the first to-be-detected portions are convex portions or concave portions which are detected by the contact-type sensor while the second detecting means is a non-contact type sensor and the second to-be-detected portions are marks which are detected by the non-contact type sensor.

For achieving the aforementioned third object, a wire-reel identifying method according to eighth aspect of the present application is a wire-reel identifying method used in a reinforcing bar binder including a storing chamber which is provided in a binder main body and mounts a wire reel around which a reinforcing-bar binding wire is wound to wind said wire around a reinforcing bar and then to twist said wire for binding of said reinforcing bar while rotating said wire reel to feed said wire, wherein the amount of rotation of the wire reel is detected and the number of to-be detected portions provided on the wire reel is detected during the detected amount of rotation of the wire reel for identifying the type of the wire reel.

For achieving the aforementioned third object, in the wire-reel identifying method according to ninth aspect of the present application, the amount of feeding of the wire or the twisting torque on the wire is adjusted in accordance with the identified type of the wire reel.

For achieving the aforementioned third object, a wire-reel identifying method according to tenth aspect of the present application is a wire-reel identifying method used in a reinforcing bar binder including a storing chamber which is provided in a binder main body and mounts a wire reel around which a reinforcing-bar binding wire is wound to wind said wire around a reinforcing bar and then to twist said wire for binding of said reinforcing bar while rotating said wire reel to feed said wire, first to-be-detected portions provided on the reel main body are detected by a first detecting means for detecting the amount of rotation of the wire reel; and the number of second to-be detected portions provided on the wire reel is detected by a second detecting means during the detected amount of rotation of the wire reel for identifying the type of the wire reel.

For achieving the aforementioned third object, in the wire-reel identifying method according to a eleventh aspect of the present application, the first detecting means is a contact-type sensor and the first to-be-detected portions are convex portions or concave portions which are detected by the contact-type sensor while the second detecting means is a non-contact type sensor and the second to-be-detected portions are marks which are detected by the non-contact type sensor.

BEST MODE FOR CARRYING OUT THE INVENTION

Figure 1:
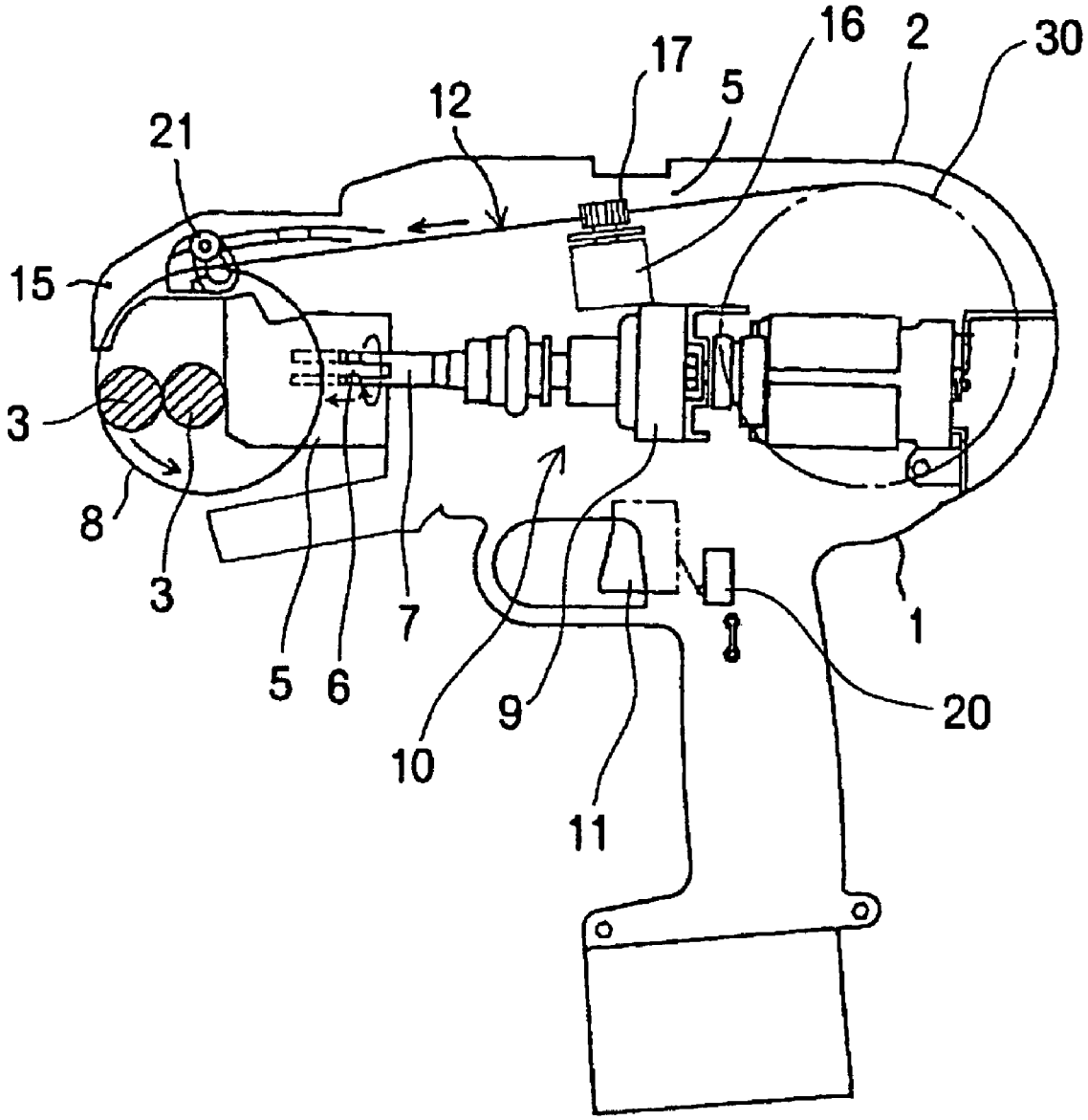
FIG. 1 is a general view illustrating the general outline of a reinforcing bar binder according to the present invention.
Figure 2:
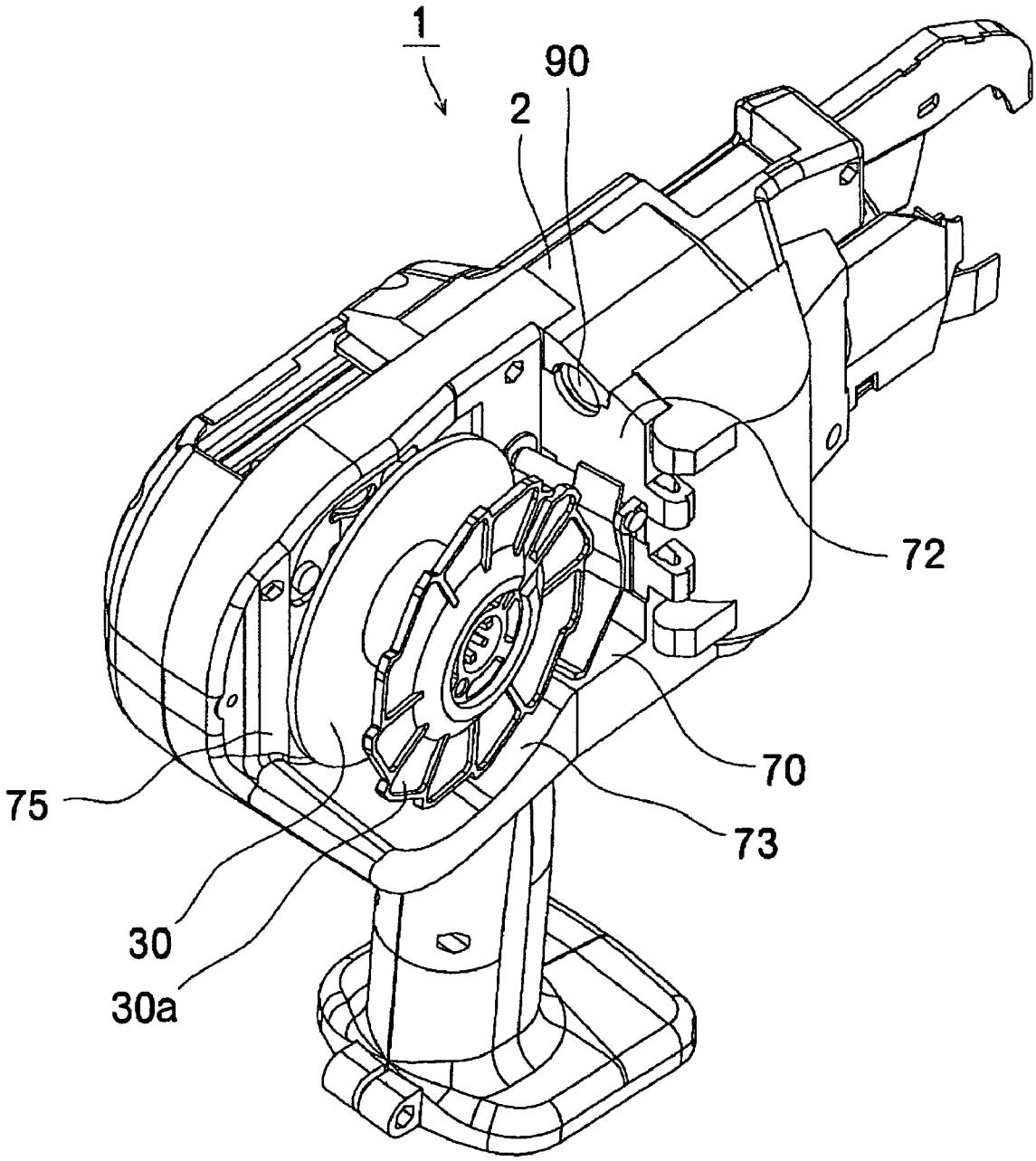
FIG. 2 is a perspective view of the reinforcing bar binder wherein the cover is removed.
Figure 3:
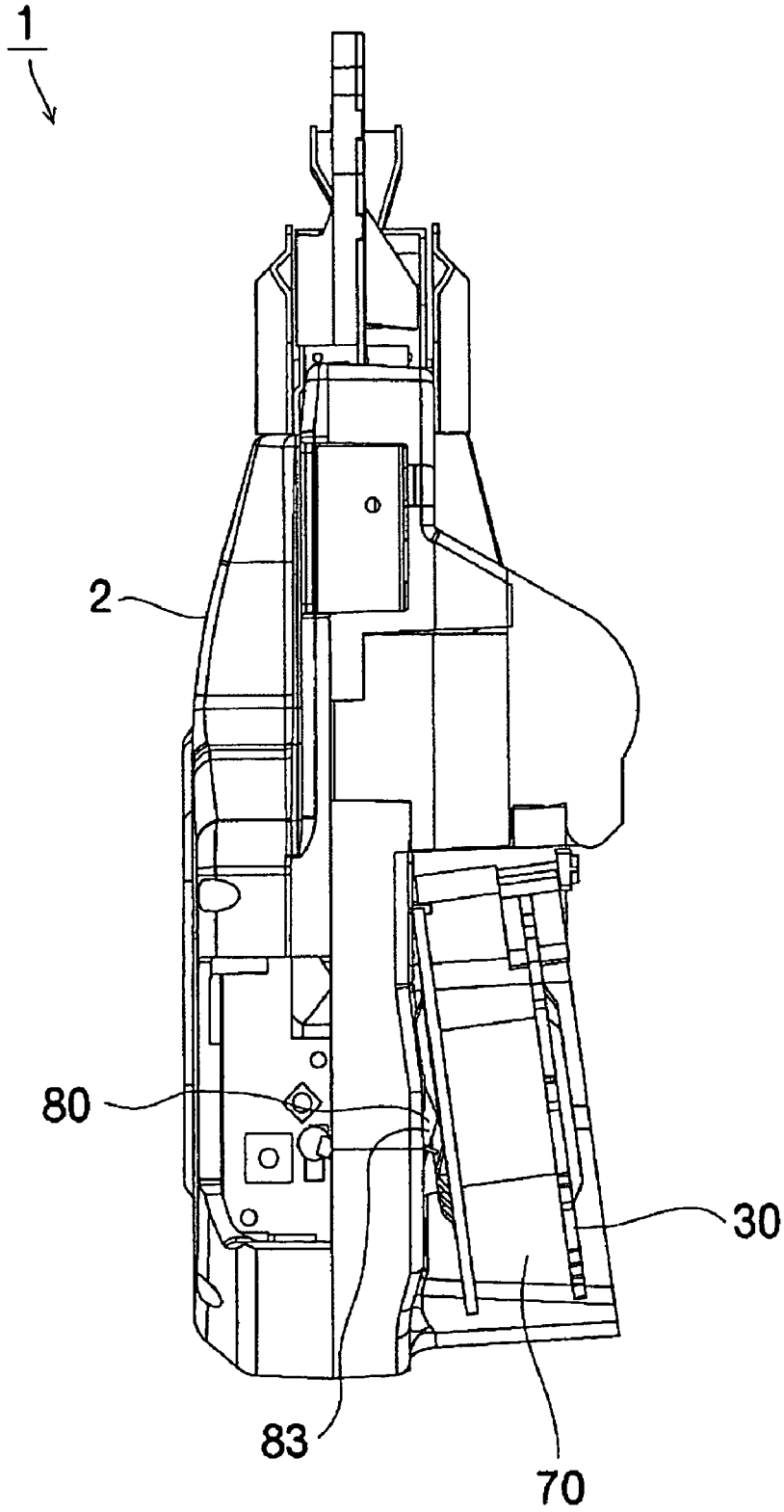
FIG. 3 is a top view of the reinforcing bar binder wherein the cover is removed.
Figure 4:
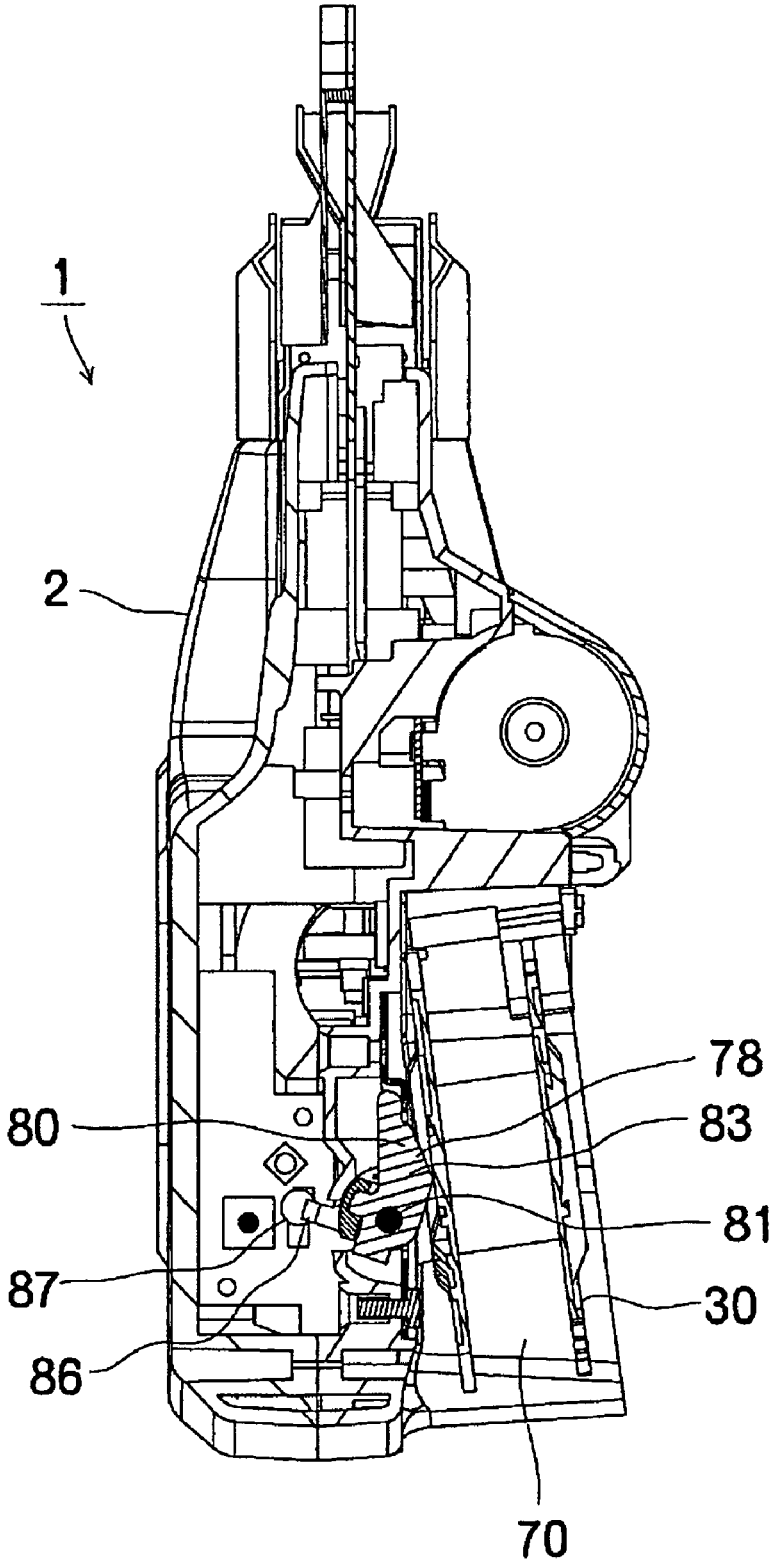
FIG. 4 is a top cross-sectional view of the reinforcing bar binder wherein the cover is removed.
Figure 5:
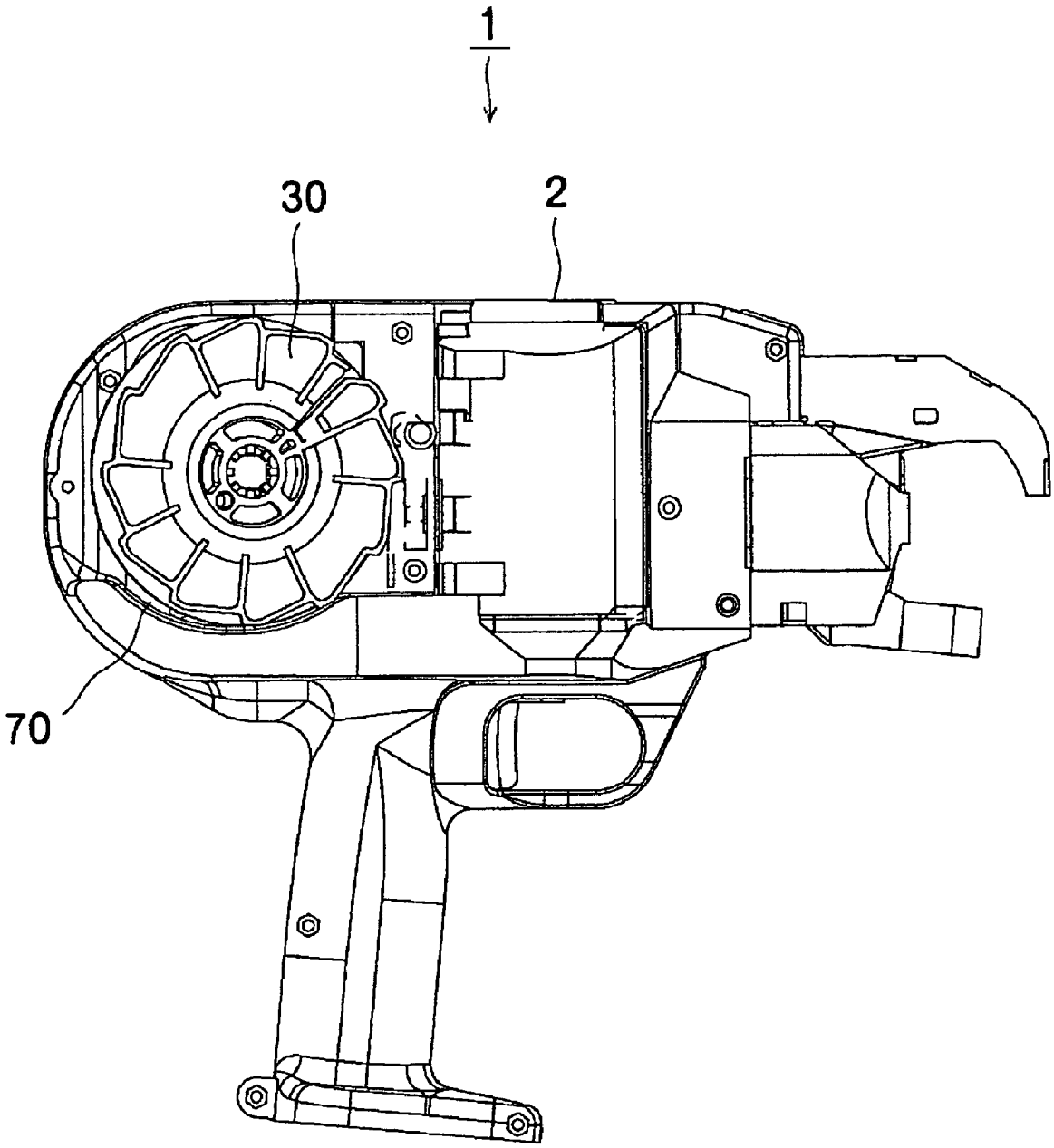
FIG. 5 is a right side view of the reinforcing bar binder wherein the cover is removed.
Figure 6:
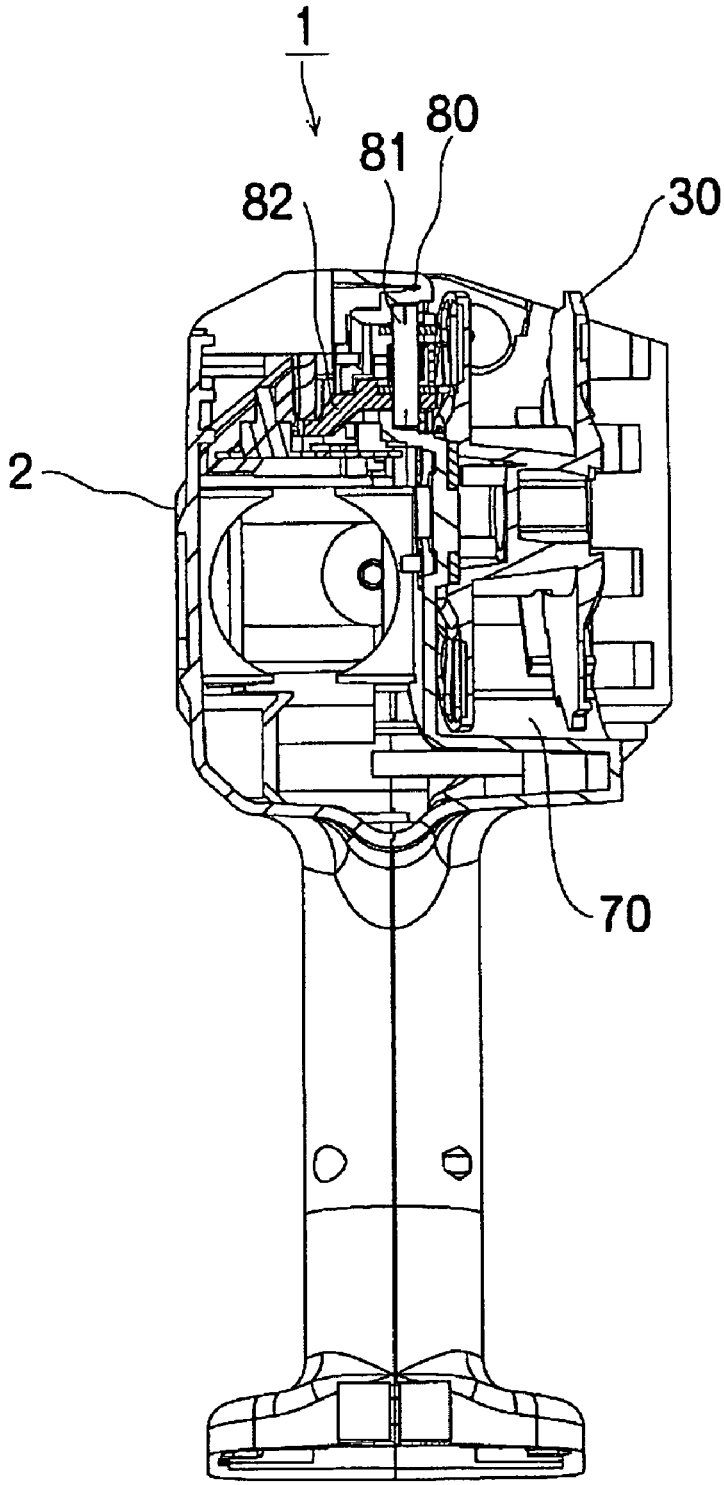
FIG. 6 is a back side cross-sectional view of the reinforcing bar binder wherein the cover is mounted.

A reinforcing bar binder 1 includes a storing chamber 70 which is provided in a binder main body 2 and mounts a wire reel 30 around which a reinforcing-bar binding wire 8 is wound, as illustrated in FIG. 1 and FIG. 2. The reinforcing bar binder 1 feeds the wire 8 while rotating the wire reel 30, winds the wire 8 around a reinforcing bar 3 and then twists it to bind the reinforcing bar 3. In the storing chamber 70, there are provided a first detecting means 80 for detecting the amount of rotation of the aforementioned wire reel 30 and a second detecting means 25 for detecting the number of second to-be-detected portions 53 on the wire reel 30 during the amount of rotation detected by the first detecting means 80. In the binder maim body 2, there is provided a control means for controlling the amount of feeding of the wire 8 or the twisting torque on the wire 8, on the basis of the number of the second to-be-detected portions 53 detected by the second detecting means 25.

Figure 18:
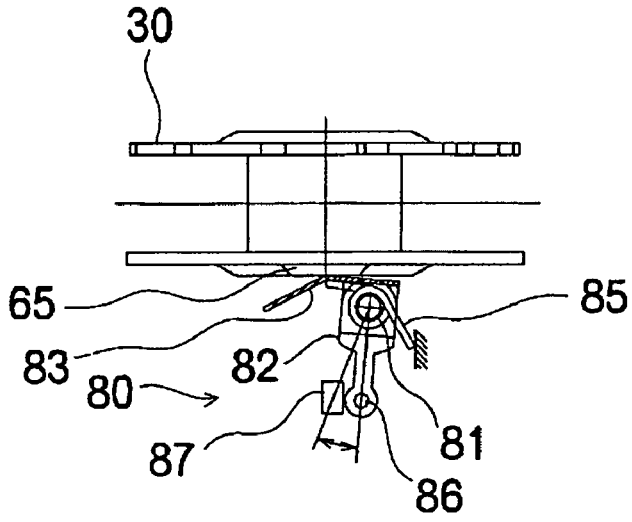
FIG. 18 is an explanation view of the state where the wire reel is mounted.
Figure 18:
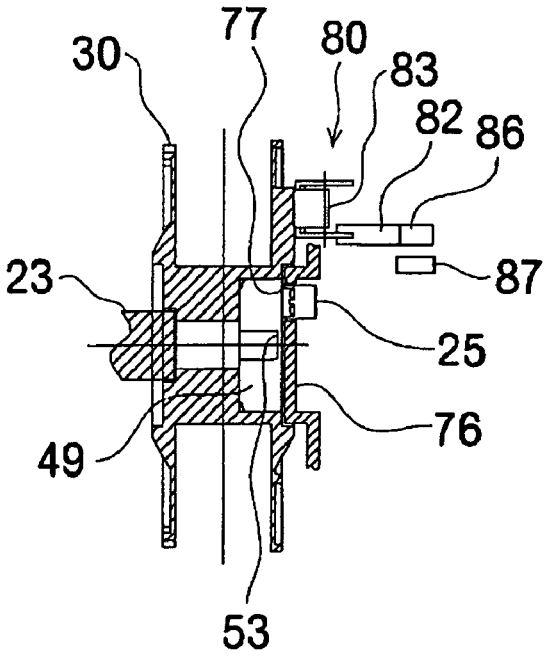
Figure 18:
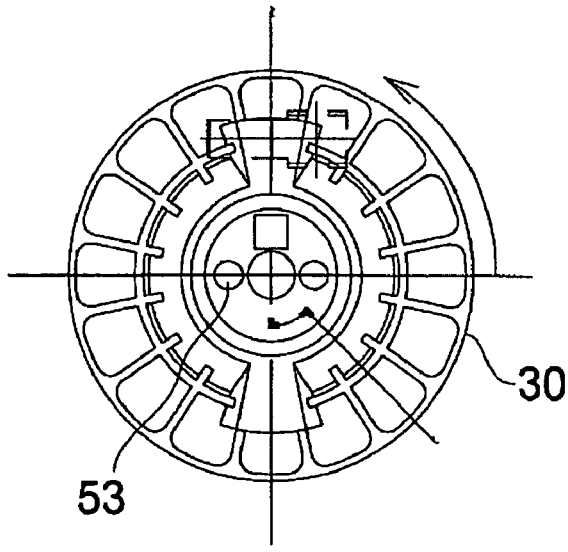
Figure 19:
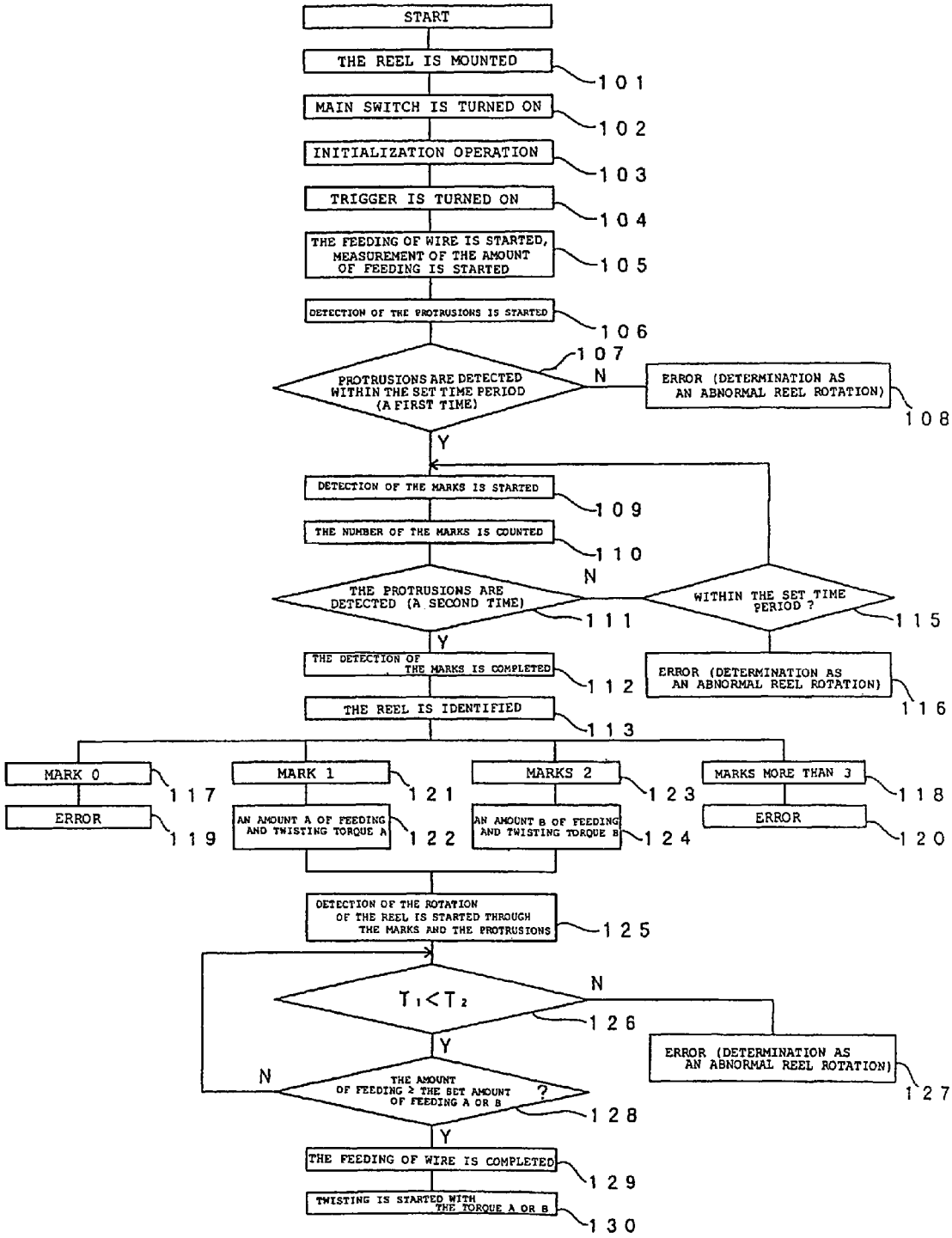
FIG. 19 is a flow chart illustrating the operation of the reinforcing bar binder.

The first detecting means 80 detects the amount of rotation of the wire reel 30 by detecting first to-be-detected portions 65 on the wire reel 30, as illustrated in FIG. 18. The first detecting means 80 may be a contact-type sensor and the first to-be-detected portions 65 may be convex portions or concave portions which can be detected by the contact-type sensor 80 while the second detecting means 25 may be a non-contact type sensor and the second to-be-detected portions 53 may be marks which can be detected by the non-contact type sensor 25.

The wire reel 30 is used in the reinforcing bar binder 1 in which the wire reel 30 around which the reinforcing-bar binding wire 8 is wound is mounted in a storing chamber 70 provided in the binder main body 2, the aforementioned wire 8 is wound around the reinforcing bar 3 and then twisted to bind the reinforcing bar 3, as illustrated in FIG. 2. The reel main body 30*a* is provided with the first to-be-detected portions 65 which are detected by the first detecting means 80 of the reinforcing bar binder 1 and the second to-be-detected portions 53 which are detected by the second detecting means 25 of the reinforcing bar binder 1.

The first to-be-detected portions 65 are detected by the first detecting means 80 so that the amount of rotation of the wire reel 30 is detected while the second to-be-detected portions 53 are detected by the second detecting means 25 so that the type of the wire reel 30 is identified. The first detecting means 80 may be a contact-type sensor and the first to-be-detected portions 65 may be convex portions or concave portions which can be detected by the contact-type sensor 80 while the second detecting means 25 may be a non-contact type sensor and the second to-be-detected portions 53 may be marks which can be detected by the non-contact type sensor 25.

Figure 7:
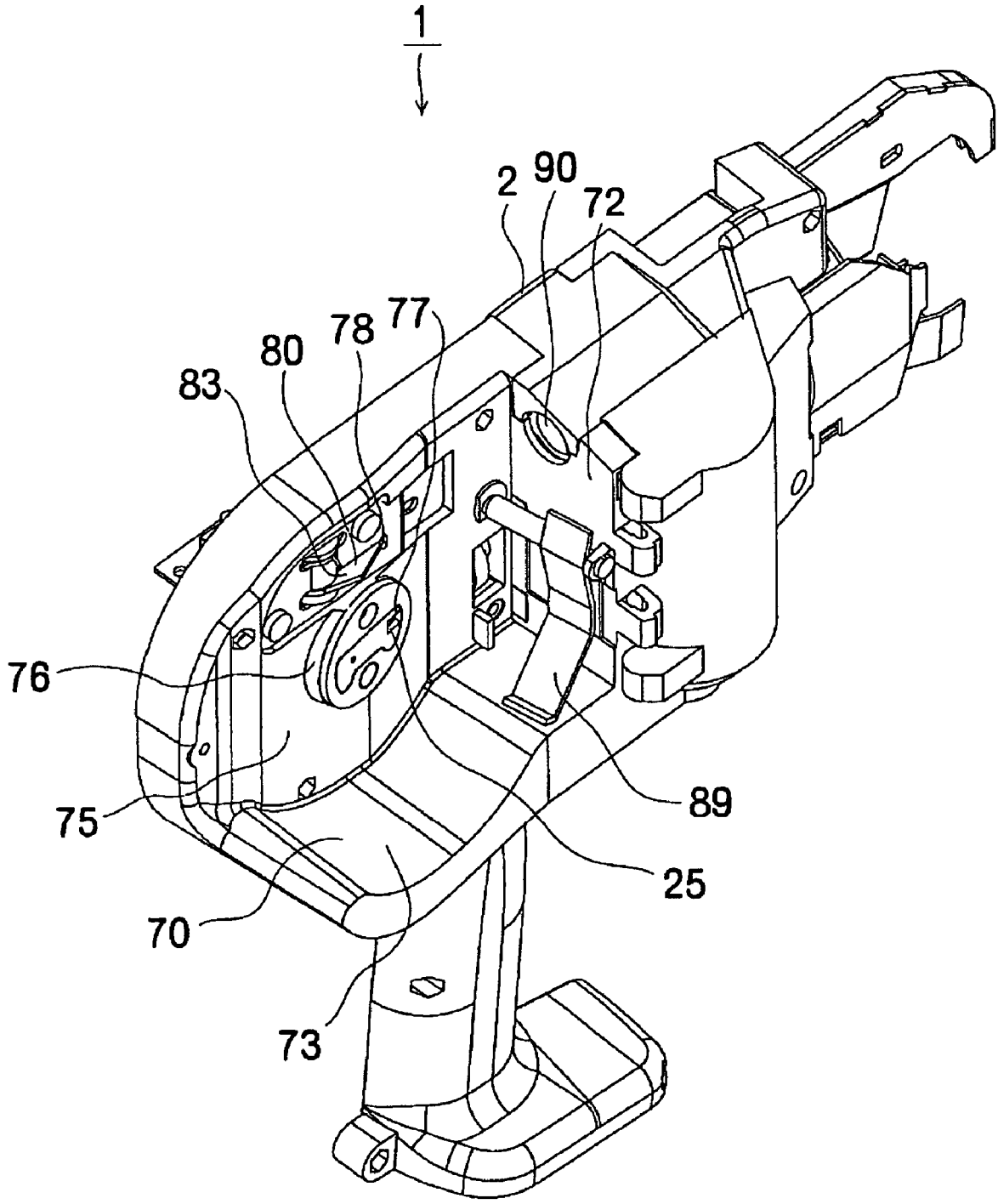
FIG. 7 is a perspective view of the reinforcing bar binder wherein the wire reel of FIG. 2 is removed.
Figure 8:
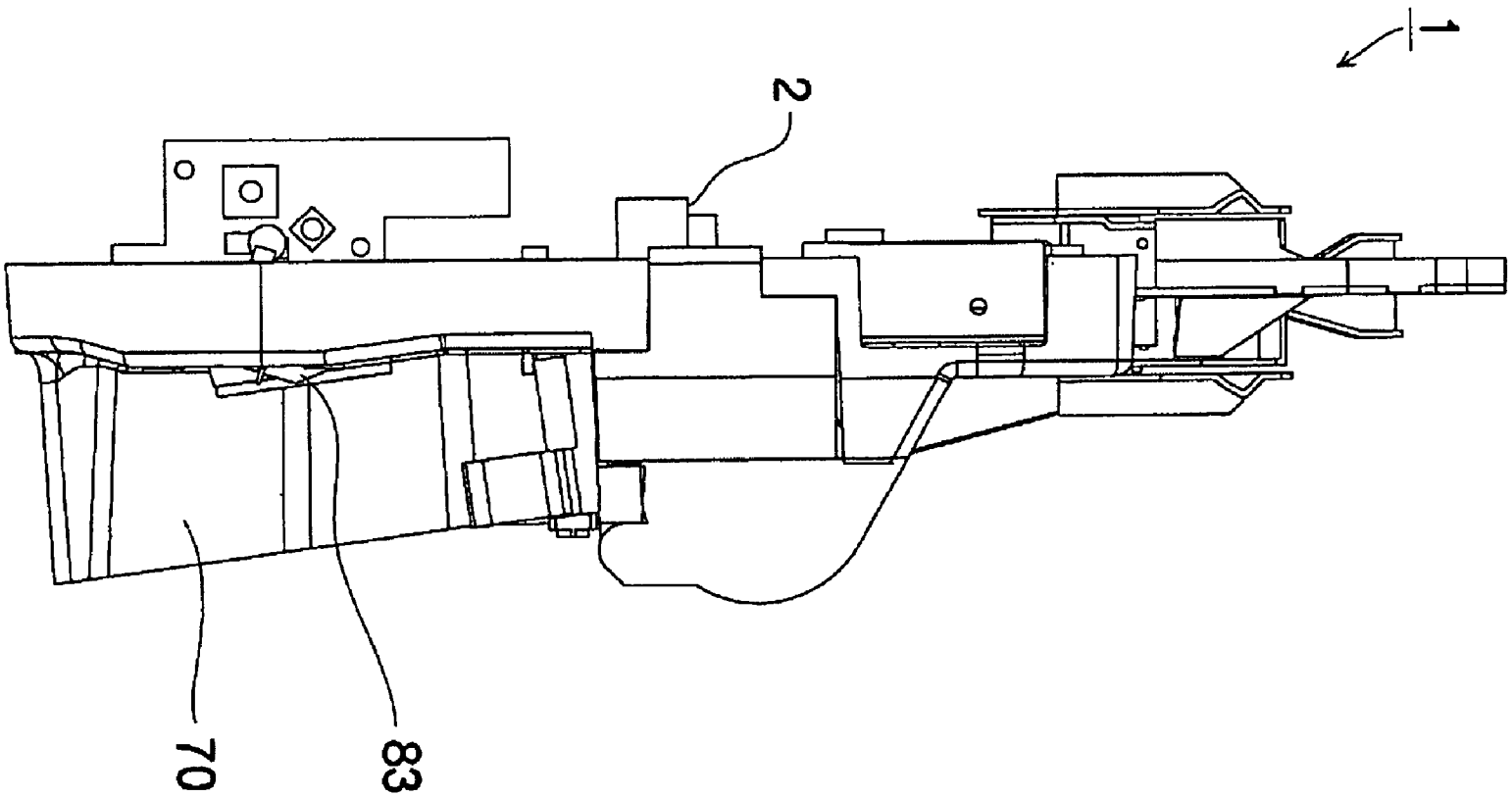
FIG. 8 is a top view of the reinforcing bar binder wherein the wire reel of FIG. 3 is removed.
Figure 9:
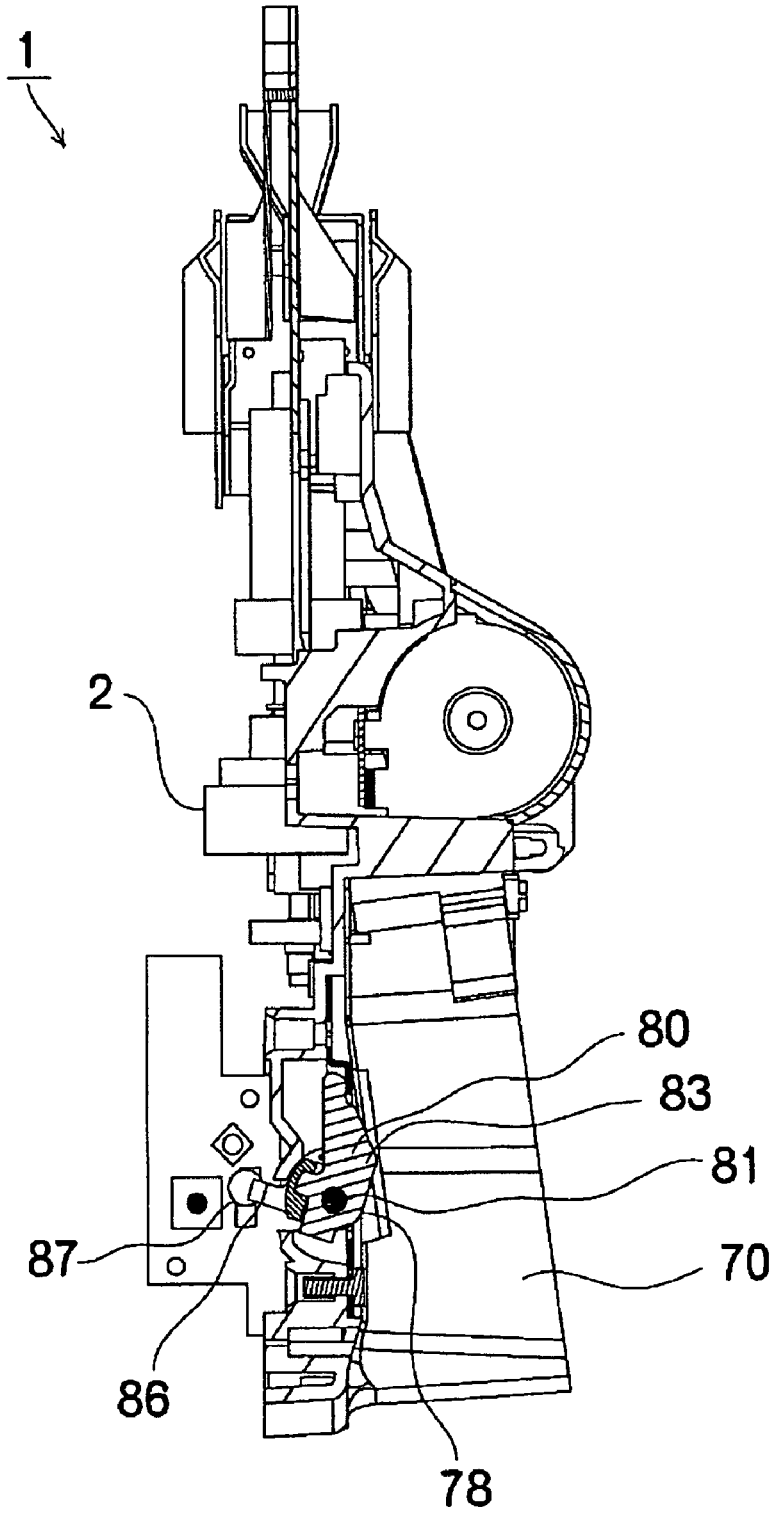
FIG. 9 is a top cross-sectional view of the reinforcing bar binder wherein the wire reel of FIG. 4 is removed.

The method for identifying the wire reel 30 is used in the reinforcing bar binder 1 in which the wire reel 30 around which the reinforcing-bar binding wire 8 is wound is mounted in the storing chamber 70 provided in the binder main body 2, the wire is fed while the aforementioned wire reel 30 is rotated, the wire 8 is wound around the reinforcing bar 3 and then twisted to bind the reinforcing bar 3, as illustrated in FIG. 7. The first to-be-detected portions 65 provided on the reel main body 30*a* are detected by the first detecting means 80 so that the amount of rotation of the wire reel 30 is detected while the number of the second to-be-detected portions 53 provided on the reel main body 30*a* is detected by the second detecting means 25 during the detected amount of rotation of the wire reel 30 so that the type of the wire reel 30 is identified.

The method for identifying the wire reel 30 enables adjusting the amount of feeding of the wire 8 or the twisting torque on the wire 8, on the basis of the identified type of the wire reel 30. The first detecting means 80 may be a contact-type sensor and the first to-be-detected portions 65 may be convex portions or concave portions which can be detected by the contact-type sensor 80 while the second detecting means 25 may be a non-contact type sensor and the second to-be-detected portions 53 may be marks which can be detected by the non-contact type sensor 25.

The reinforcing bar binder 1 will be described in detail. The reinforcing bar binder 1 includes a pair of abutting plate portions 5 which abut against the reinforcing bar 3 at the lower portion of the front end portion of the binder main body 2 which faces the reinforcing bar 3 and further includes a twisting hook 7 having a wire-inserting groove 6 at the tip end portion thereof between the pair of abutting plate portions 5. The twisting hook 7 can be rotated by an electric motor 9. The twisting hook 7 stays at a position spaced apart from the wire 8 with the wire inserting groove 6 faced in parallel with the loop-shaped wire 8 during standby prior to the start of the rotation of the electric motor 9, in order to facilitate the insertion of the wire 8 curved in a loop shape into the wire-inserting groove 6.

The twisting hook 7 is held on the electric motor 9 through a forward/backward moving mechanism 10. The forward/backward moving mechanism 10 is constituted by a cam mechanism, for example. The forward/backward moving mechanism 10 inserts the wire 8 into the wire inserting groove 6 of the twisting hook 7 at the start of the rotation of the electric motor 9 and pulls back the twisting hook 7 to the standby position when the rotation of the electric motor 9 is stopped. Namely, when a trigger 11 is pulled to start the rotation of the electric motor 9, the twisting hook 7 extends towards the wire 8 to insert the wire 8 into the wire-inserting groove 6, rotates by a predetermined amount, and then stops to return to the original standby position.

The binder main body 2 includes a wire path 12 for passing the wire 8 therethrough. The wire path 12 extends from the rear end portion of the binder main body 2 up to a guide portion 15 which bends the wire so as to be easily wound. The guide portion 15 is curved in an arc shape and the wire path 12 forms a groove opened at the arc inner portion at the guide portion 15. A gear 17 mounted on the output shaft of a motor 16 is provided on the wire path 12 at the middle position of the binder main body 2. The gear 17 is exposed at an opening portion (not shown) which is provided in the wire path 12 and the gear 17 presses the wire 8 against the bottom portion of the wire path 12. The motor 16 and the gear 17 constitute the feeding device for the wire 8 and the wire 8 is fed forward through the normal rotation of the motor 16.

When a micro switch 20 is turned on through the trigger 11, the motor 16 is caused to rotate, thus rotating the wire feeding gear 17. Through the rotation of the wire feeding gear 17, the wire 8 wound around the wire reel 30 which is housed within the storing chamber 70 is fed to the forward portion of the binder main body 2 through the wire path 12 in the guide portion 15. Further, the normal and reverse rotation of the motor 16 may be controlled by a control circuit (not shown) incorporated in the binder main body 2 such that, for example, the wire 8 is wound around the reinforcing bar 3 in a loop shape and thereafter the wire 8 is pulled on the wire reel 30 towards the storing chamber 70 to reduce the looseness in the wire 8.

At the portion of the wire path 12 which reaches the guide portion 15, there is provided a wire gripping/cutting means 21. The wire gripping/cutting means 21 is constituted by, for example, a pair of gripping portions and a pair of cutting blades such that the wire 8 passes between the pair of gripping portions and between the pair of cutting blades. The wire gripping/cutting means 21 causes the pair of cutting blades to contact and intersect with each other to cut the wire 8 when the feeding amount of the wire 8 reaches a predetermined amount, on the basis of the amount of the rotation of the motor 16. Thereafter, the end portion of the wire 8 is gripped by the pair of gripping portions, and the wire 8 wound around the reinforcing bar 3 in a loop shape is twisted by the twisting hook 7 with the rear end portion of the loop gripped by the pair of gripping portion to bind the reinforcing bar 3.

Figure 15:
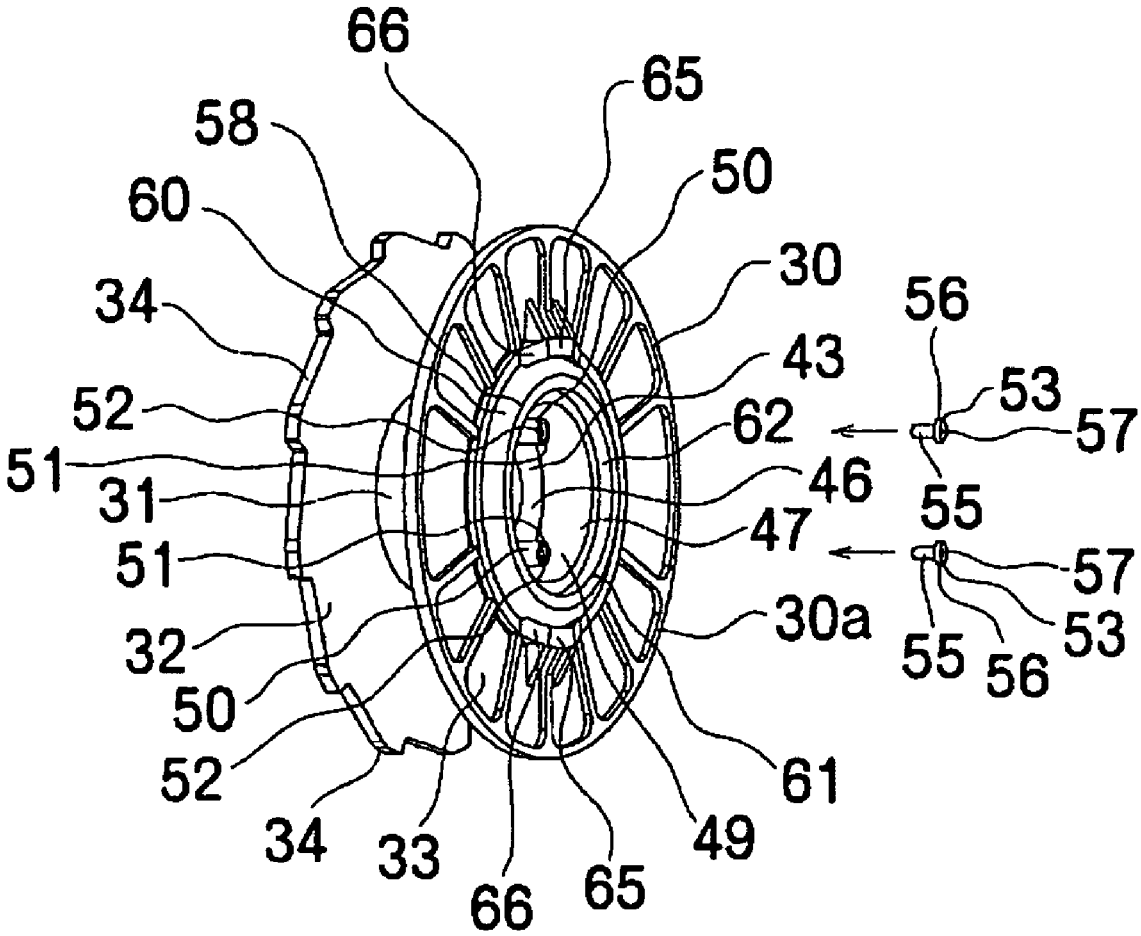
FIG. 15 is a perspective view of the wire reel.
Figure 16:
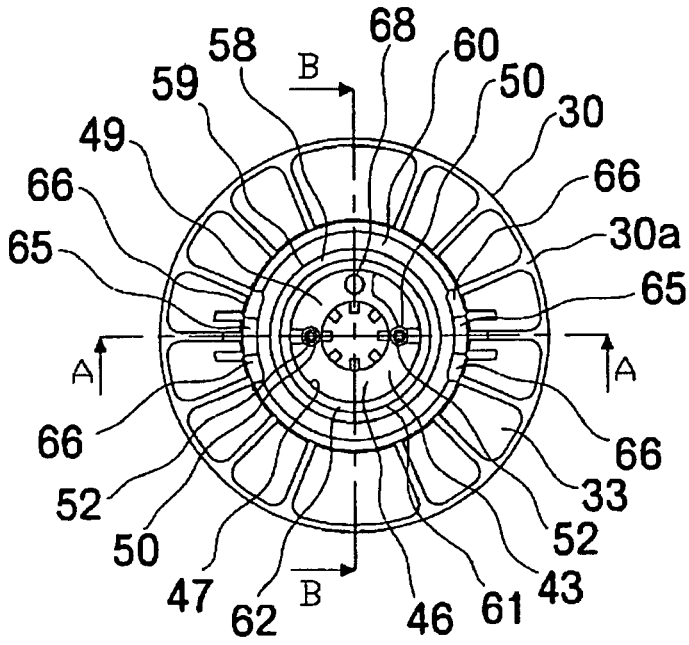
FIG. 16 is an explanation view of the wire reel, wherein (a) is a front view of the wire reel, (b) is a cross-sectional view taken along A-A of (a) and (c) is a cross-sectional view taken along B-B of (a).
Figure 16:
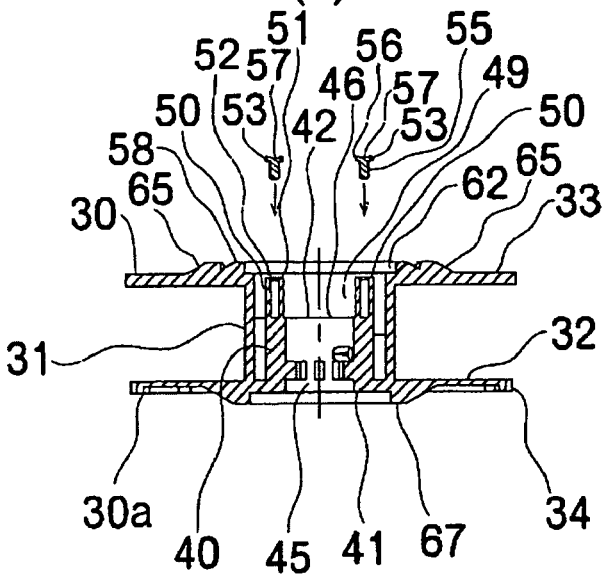
Figure 16:
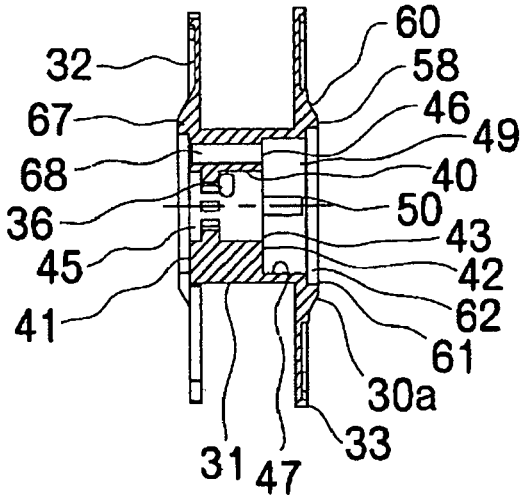
Figure 17:
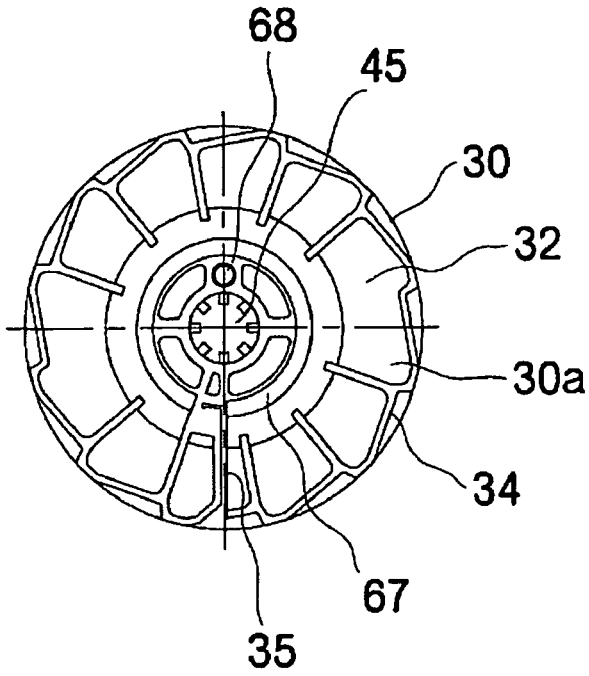
FIG. 17 is an explanation view of the wire reel, wherein (a) is a back view of the wire reel, (b) is a side view and (c) is a cross-sectional view taken along C-C of (b).
Figure 17:
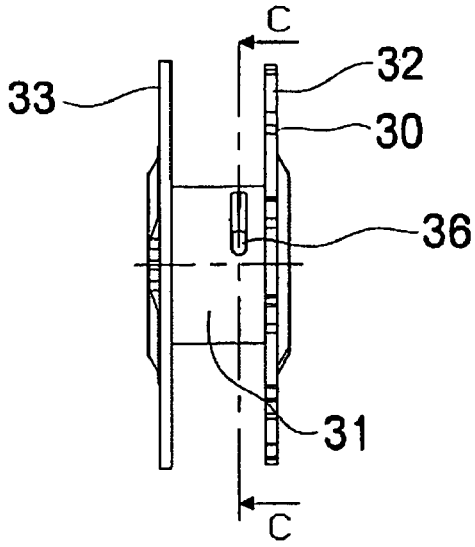
Figure 17:
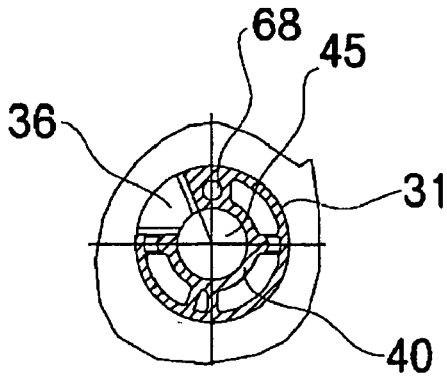

At the rear portion of the binder main body 2, there is formed the storing chamber 70 for housing the wire reel 30 around which the wire 8 is wound. Prior to description of the storing chamber 70, the wire reel 30 will be described on the basis of FIGS. 15 to 17. The wire reel 30 is made of a plastic such as an ABS resin, polyethylene or polypropylene which has excellent resistance to wear and bending, and made of a black plastic in order to prevent the entry of external disturbing light into a hub portion 31. The wire reel 30 is constituted by the hub portion 31 for winding the wire 8 therearound and disk-shaped flanges 32 and 33 provided at the opposite sides of the hub portion 31. The hub portion 31 is formed to have a cylindrical shape and is formed integrally with the pair of flanges 32, 33. Engaging pawls 34 are formed around the outer periphery of one flange 32.

The hub portion 31 includes an inner cylinder 40, which is substantially coaxial with the hub portion 31, at the center portion thereof and a mounting hole 45 for inserting a reel mounting shaft 23 of the reinforcing bar binder 1 thereinto inside the inner cylinder 40. The inner cylinder 40 is formed to be shorter than the hub portion 31 and one end 41 thereof is positioned near the flange 32 while the other end 42 is formed to be slightly beyond the substantial middle position of the hub portion 31. The other end 42 is coupled to the hub portion 31 through a side wall 46. The side surface 43 of the side wall 46 closer to the flange 33 and the inner surface 47 of the hub 31 define a round concave portion 49.

On the side surface 43 of the side wall 46 closer to the flange 33, there are provided a pair of fixation shafts 50, 50 protruding opposite to each other. The tip ends 51 of the fixation shafts 50 are extended to the vicinity of the flange 33 and are provided with a fitting hole 52. The marks 53 are fitted within the fitting holes 52. The marks 53 are made of a white plastic in order to increase the amount of light which is reflected and received, and are constituted by a fitting shaft 55 to be fitted in the fitting hole 52 and a reflection plate 56 formed at the tip end of the fitting shaft 55. A gently-curved concave portion 57 is formed on the surface of each of the reflection plates 56. The pair of fixation shafts 50, 50 are housed within the concave portions 49.

A ring-shaped boss portion 58 is formed on the flange 33 to surround the round concave portion 49. The boss portion 58 includes a tapered surface 60 at the outer peripheral edge 59 thereof and a stepped concave portion 62 at the inner peripheral edge 61 thereof. The stepped concave portion 62 has a depth which substantially reaches the tip ends of the aforementioned fixation shafts 50, 50. Further, a pair of protrusions 65, 65 are formed opposite to each other on the outer peripheral edge 59 of the boss portion 58. The protrusions 65, 65 are formed to have a trapezoid shape and include inclined edges 66, 66 at their opposite sides.

While the protrusions 65, 65 are placed at substantially the same angles as the aforementioned fixation shafts 50, 50, the positional relationship between the protrusions 65, 65 and the fixation shafts 50, 50 is not limited thereto. Further, while the two fixation shafts 50, 50 are employed in the present embodiment, the number of the fixation shafts is not limited thereto and may be one, or three or more. Further, a boss portion 67 similar to that on the flange 33 is also provided on the flange 32 such that it is opposite to the aforementioned boss portion 58.

Further, a cylindrical hole 68 which enables the detection of the rotational position of the wire reel 30 is formed through the side wall 46. A light emitting device and a light receiving device may be placed within the region of the rotation of the hole 68 in the reinforcing bar binder 1 such that the hole 68 passes between the both devices to enable the determination of the condition of the rotation of the wire reel 30. There are formed substantially sector-shaped patterns, which are strengthening ribs of the thinned flanges 32, 33, around the outer peripheral edges of the flanges 32, 33.

In the flange 32, a wire-inserting opening portion 35 is formed to extend from the outer peripheral edge to the hub portion 31. The winding termination end of the wire 8 is engaged and held within the wire-inserting opening portion 35. A wire-inserting hole 36 is formed through the hub portion 31 and the inner cylinder 40. The winding starting end of the wire 8 is inserted and held within the wire-inserting hole 36. When winding the wire 8, the winding starting end of the wire 8 is inserted into the wire-inserting hole 36 and is wound within the inner cylinder 40 to prevent the winding starting end from pulling out of the wire-inserting hole 36 and, in this state, the winding of the wire around the peripheral surface of the hub 31 is started. Further, in the event that the wire 8 is subjected to a large force in the direction of winding, the tensile force can be received at the edge portion of the wire-inserting opening portion 35.

Figure 10:
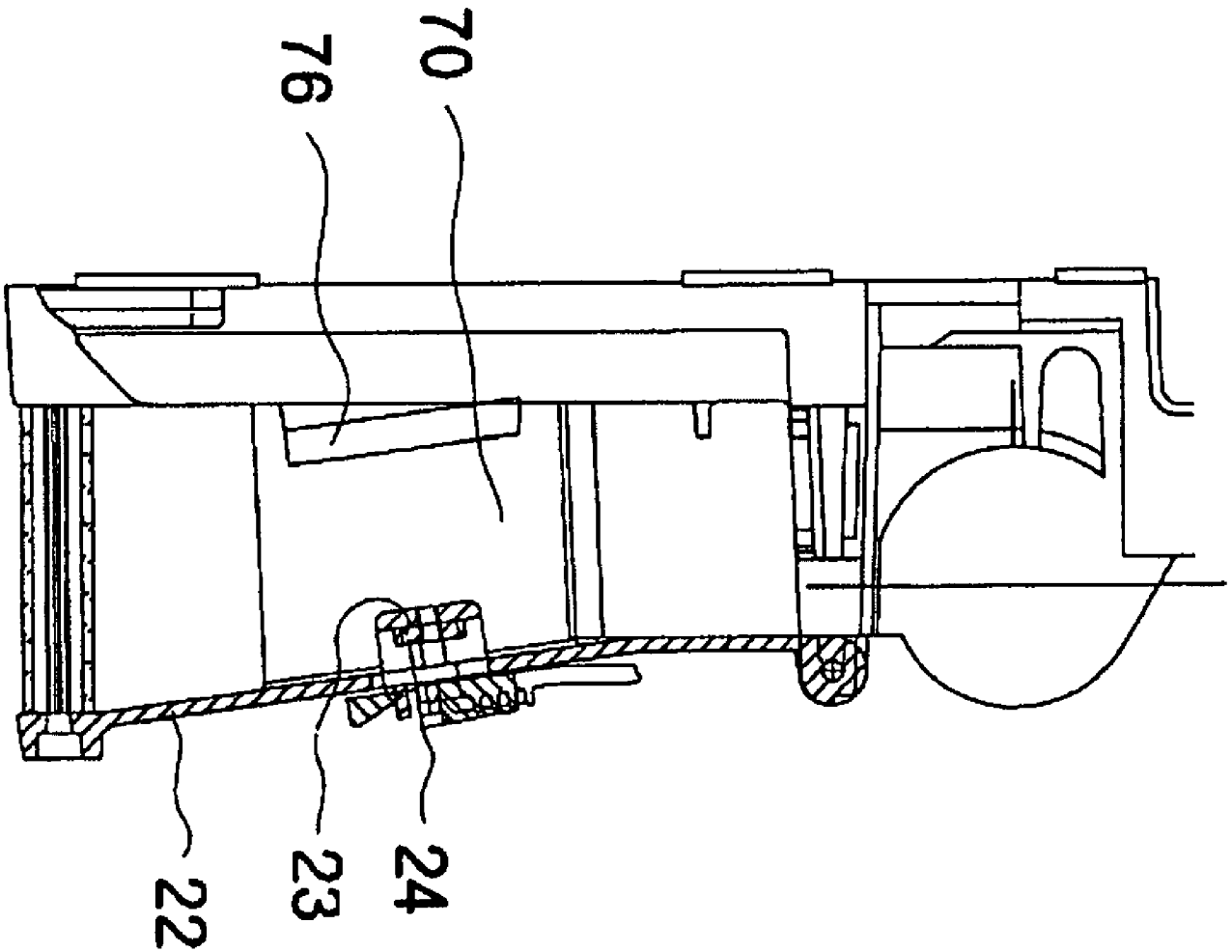
FIG. 10 is an explanation view illustrating the state where the cover is mounted.
Figure 11:
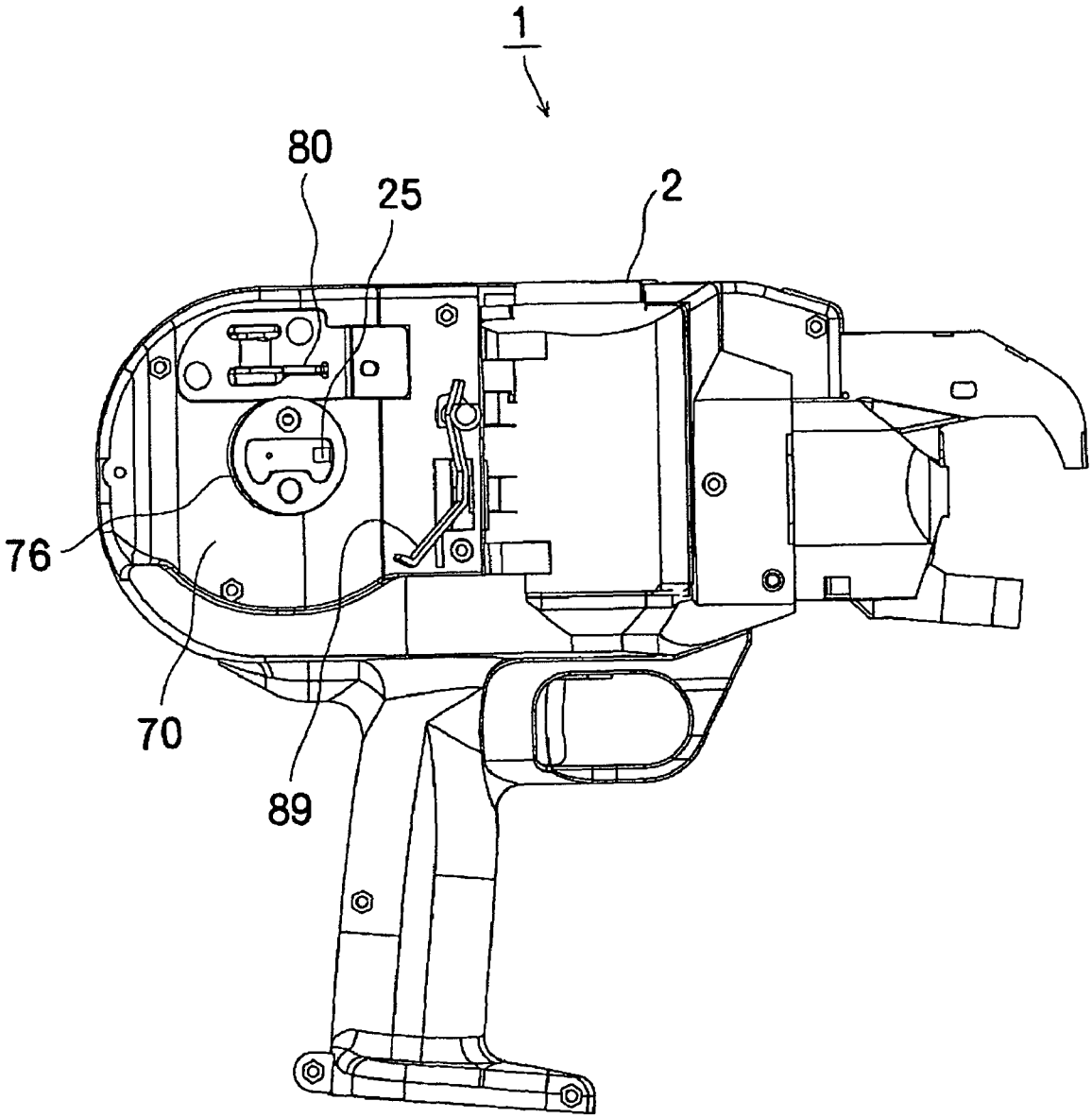
FIG. 11 is a right side view of the reinforcing bar binder wherein the wire reel of FIG. 5 is removed.
Figure 12:
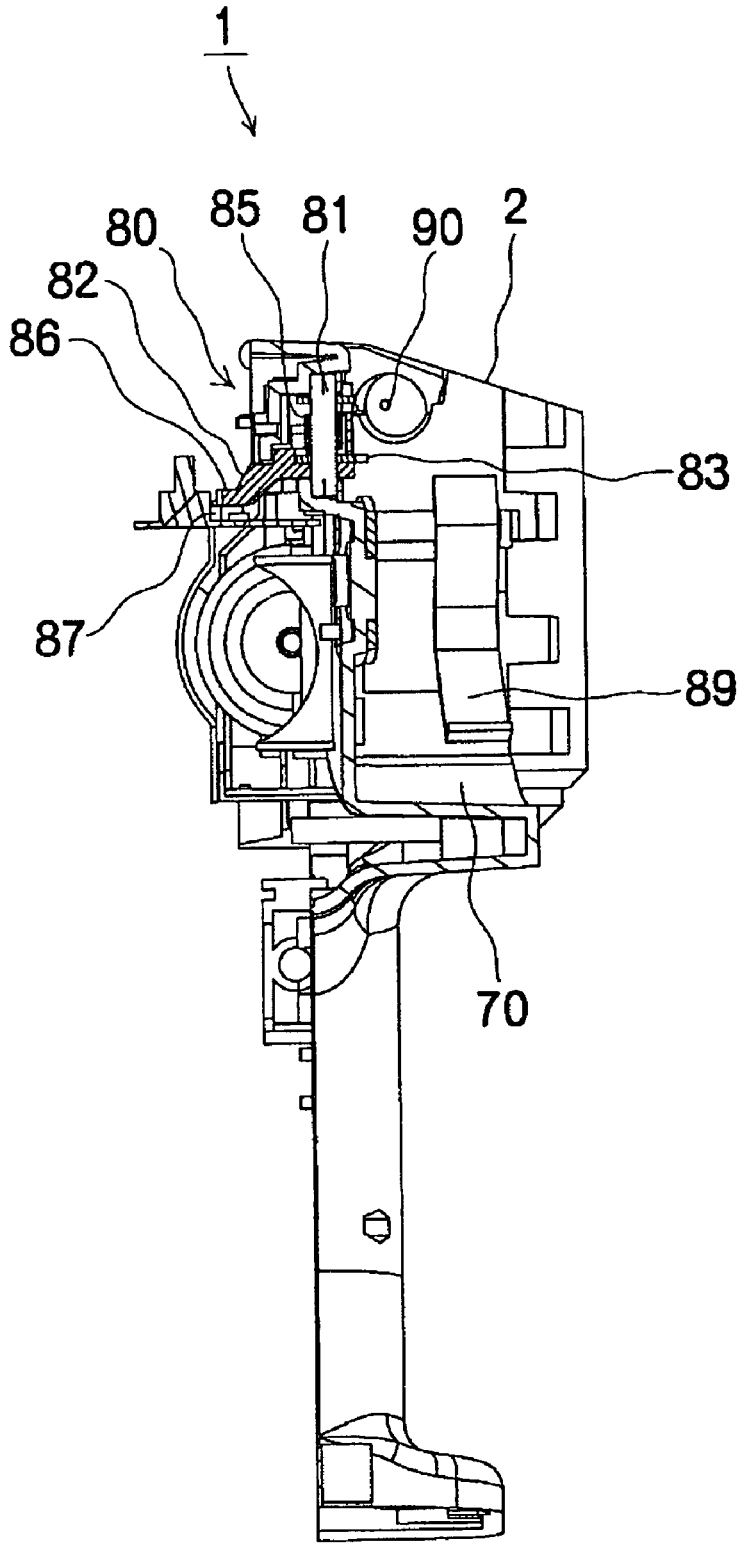
FIG. 12 is a back side cross-sectional view of the reinforcing bar binder wherein the wire reel of FIG. 6 is removed.
Figure 13:
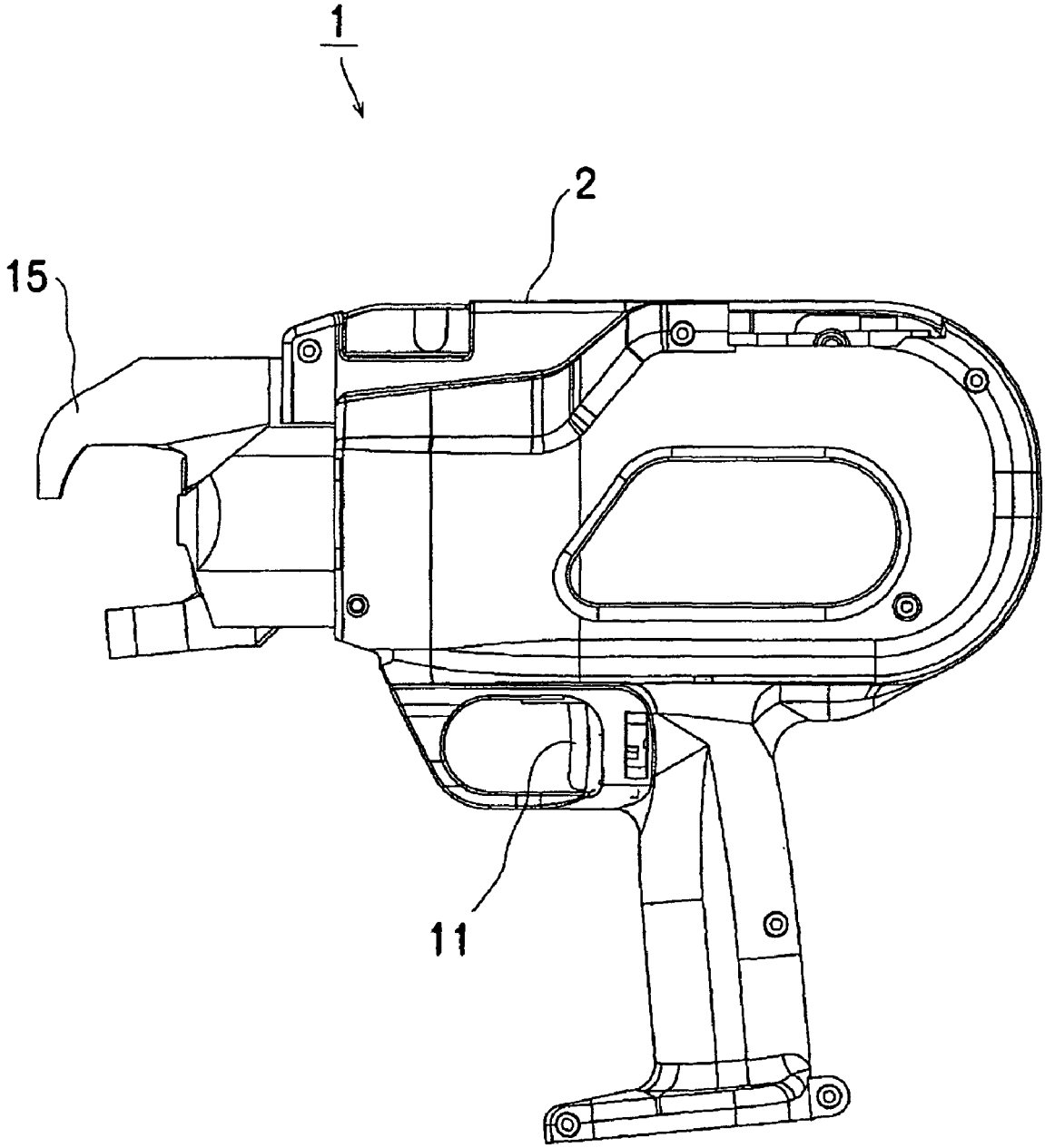
FIG. 13 is a left side view of the reinforcing bar binder.
Figure 14:
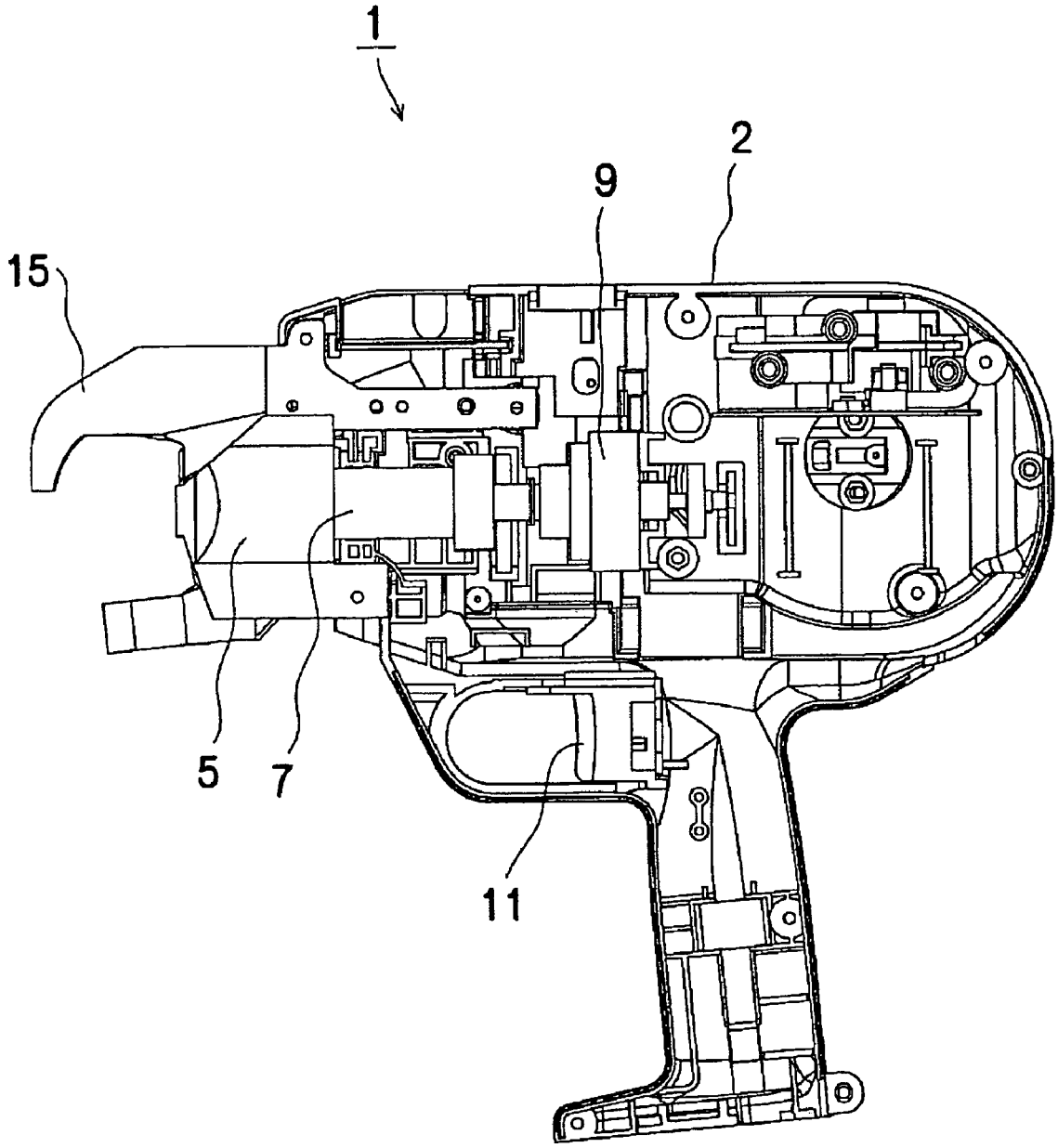
FIG. 14 is a left side cross-sectional view of the reinforcing bar binder.

The storing chamber 70 of the reinforcing bar binder 2 can be covered with a cover member 22 which is secured to one side thereof through hinge coupling, as illustrated in FIG. 10. The cover member 22 is provided with a reel mounting shaft 23 which is freely projected and recessed and is fitted in the mounting hole 45 in the wire reel 30. The cover member 22 is provided with a reel stopper 24 which locks the reel mounting shaft 23 with the reel mounting shaft 23 protruded (set) into the storing chamber 70. The storing chamber 70 is constituted by a front wall 72, a bottom wall 73 and a side wall 75, as illustrated in FIG. 7. On the side wall 75, there is formed a round-shaped protruding portion 76 which is fitted in the step concave portion 62 of the wire reel 30. A non-contact type sensor (optical sensor, interrupter) 25 is provided in the protruding portion 76. When the protruding portion 76 is fitted in the step concave portion 62, as illustrated in FIG. 18, the entry of light into the concave portion 49 is prevented and also the entry of external disturbing light into the interrupter 25 is avoided. The optical sensor 25 is constituted by a light emitting device and a light receiving device, and the marks 53 to be detected by the optical sensor 25 include a curved concave portion 57 at their upper ends so that light emitted from the light emitting device is concentrated to the light receiving device, which enables certain detection of the marks 53.

A sensor placing hole 77 is formed in the protruding portion 76 and the reflection-type interrupter 25 which is the aforementioned non-contact type sensor is installed as an optical sensor within the sensor placing hole 77. The optical sensor 25 is connected to the aforementioned control circuit, which feeds electricity to the interrupter 25 and receives output signals from the interrupter 25. The control circuit detects the marks 53 on the wire reel 30 from output signals from the interrupter 25. The control circuit detects the number of the marks 53 by detecting the change in the output voltage from the interrupter 25.

The contact sensor (first detecting means) 80 is provided on the side wall 75 of the storing chamber 70 above the protruding portion 76. The contact sensor 80 is a mechanical switch and is constituted by a swayable member 82 which is swayably provided on a supporting shaft 81, a contact piece 83 provided at the tip end of the swayable member 82, an elastic member 85 which biases the contact piece 83 towards the wire reel 30, a magnet portion 86 provided at the other end of the swayable member 82 and a Hall IC 87 with which the magnet portion 86 is brought into contact by the elastic member 85.

The switch which is the contact sensor (first detecting means) 80 is provided within the binder main body 2, and the contact piece 83 is protruded from an opening portion 78 formed in the side wall 75. The protrusions (first to-be-detected portions) 65 on the reel main body 30*a* come into contact with the contact piece 83. In the switch which is the contact sensor (first detecting means) 80, when the protrusions (first to-be-detected portions) 65 on the reel main body 30*a* come into contact with the contact piece 83, the swayable member 82 is swayed against the elasticity of the elastic member 85, thereby separating the magnet portion 86 from the Hall IC 87.

The contact sensor (first detecting means) 80 is connected to the aforementioned control circuit so that electrical signals caused by the voltage change in the Hall IC 87 are sent to the control circuit. The control circuit detects the rotation of the wire reel 30 from electrical signals from the contact sensor (first detecting means) 80. When the control circuit does not detect a change in the voltage from the contact sensor (first detecting means) 80 within a predetermined time period, the control circuit determines that the wire reel 30 is not rotated and causes light emission from an LED or the like provided on the side surface of the reinforcing bar binder 1 or warning-sound generation to inform the operator of the termination of the wire 8 on the wire reel 30.

Also, when the wire reel 30 is not normally set, such as when the setting of the reel mounting shaft 23 or the reel stopper 24 in FIG. 10 is forgotten, there is the possibility of disengagement of the wire reel 30 from the protruding portion 76 during rotation. Further, there is the possibility of falling or fling of the wire reel 30 from the storing chamber 70 depending on the orientation of the reinforcing bar binder main body 2. In this case, the contact piece 83 of the contact sensor (first detecting means) 80 can detect the disengagement of the wire reel 30 from the protruding portion 76, thus enabling informing the operator of the abnormal rotation of the wire reel 30 through light emission from an LED or the like or warming-sound generation.

Further, on the front wall 72, there is provided an elastic piece 89 which engages with the aforementioned engaging pawls 34 on the wire reel 30 to stop the rotation of the wire reel 30. The elastic piece 89 does not work during the feeding of the wire. At the completion of the feeding of wire, the elastic piece 89 acts to apply a brake to the wire reel 30 due to the activation of the electric motor 9. An opening 90 for drawing out the wire 8 is formed through the front wall 72 at the upper portion thereof. The opening 90 is communicated with the wire path 30.

In the reinforcing bar binder 1 having the aforementioned structure, the wire reel 30 is housed and mounted within the storing chamber 70 (step 101). The step concave portion 62 of the wire reel 30 is fitted with the protruding portion 76 formed on the side wall 75 of the storing chamber 70, and the reel mounting shaft 23 provided on the cover member 22 is protruded into the storing chamber 70 to insert the reel mounting shaft 23 into the mounting hole 45 of the reel main body 30*a*. At this state, the reel mounting shaft 23 is locked by the reel stopper 24. The wire 8 around the wire reel 30 is drawn out and the drawn tip end portion is fed to the wire path 30 through the opening 90 of the front wall 72 and placed on the gear 17 of the feeding device.

Since the protruding portion 76 is fitted in the step concave portion 62 of the wire reel 30, the concave portion 49 of the inner cylinder 40 is shielded from light, thus preventing the entry of external disturbing light into the interrupter (the second detecting means, the non-contact sensor) 25 within the concave portion 49. The marks (second to-be-detected portions) 53 provided on the fixation shafts 50 in the wire reel 30 rotate near the interrupter (second detecting means) 25 in the protruding portion 76 with a predetermined interval left therebetween and reflect light from the interrupter (second detecting means) 25.

After mounting the wire reel 30 in the reinforcing bar binder 1 as described above (step 101), when a main switch which is not shown is turned on (step 102), the control circuit is initialized (step 103) and the motor 16 of the feeding device is caused to rotate, thus causing the rotation of the wire feeding gear 17 so that the tip end of the wire 8 wound around the wire reel 30 which is housed within the storing chamber 70 is fed to a predetermined position. When the micro switch 20 is turned on through the trigger 11 (step 104), the motor 16 is caused to rotate, thus causing the rotation of the wire feeding gear 17 to start measurement of the amount of feeding of the wire 8 (step 105). Through the rotation of the wire feeding gear 17, the wire 8 wound around the wire reel 30 housed within the storing chamber 70 is fed to the forward portion of the binder main body 2 through the wire path 12 in the guide portion 15. Further, the control of the rotation of the motor 16 is performed by a control circuit (not shown) which is incorporated in the binder main body 2.

While the wire 8 is fed forward, the wire reel 30 is rotated, thus bringing the protrusions (first to-be-detected portions) 65 on the reel main body 30*a* into contact with the contact piece 83 of the contact sensor (first detecting means) 80. When the protrusions (the first to-be-detected portions) 65 on the reel main body 30*a* come into contact with the contact piece 83, the swayable member 82 sways against the elasticity of the elastic member 85 to separate the magnetic portion 86 from the Hall IC 87, and consequently, pulse signals are caused by the voltage change and sent to the control circuit. The control circuit starts counting the pulses to detect the protrusions (first to-be-detected portions) 65 (step 106). The control circuit performs the detection of the protrusions (first to-be-detected portions) 65 for a set time period (step 107) and, when they are not detected, namely when no pulse signal is sent within the set time period, the control circuit determines that the wire reel 30 is not rotated and causes light emission from the LED or the like provided on the side surface of the reinforcing bar binder 1 or warning-sound generation (step 108).

When the protrusions (the first to-be-detected portions) 65 are detected within the set time period, namely when pulse signals caused by the voltage change are sent to the control circuit, the control circuit recognizes that the wire reel 30 is rotated while the interrupter (second detecting means, non-contact sensor) 25 directs light thereto, detects reflected light from the marks (second to-be-detected portions) 53 provided on the fixation shafts 50 in the wire reel 30 (step 109) to detect the marks 53 and then sends detection signals to the control circuit. Thus, the control circuit counts the number of the marks 53 (step 110). After the first protrusion (first to-be-detected portion) 65 comes into contact with the contact piece 83 of the contact sensor 80, when the next protrusion (first to-be-detected portion) 65 comes into contact with the contact piece 83 of the contact sensor 80 and thus is detected (step 111), pulse signals are sent to the control circuit and then the detection is terminated (step 112). Further, the control circuit calculates the number of the marks (second to-be-detected portions) 53 which have been detected by the interrupter (second detecting means, non-contact sensor) 25 to identify the wire reel 30 (step 113).

Since the protrusions (first to-be-detected portions) 65 are provided on the reel main body 30*a* such that they are opposed to each other as previously described, the amount of rotation is ½ turn (180 degrees) and the type of the wire reel 30 is identified from the number of the marks 53 during the amount of rotation. The control circuit sets the energization time period for the motor 16 of the feeding device and the electric power supplied to the electric motor 9. When the first detecting means 80 does not detect the next protrusion (first to-be-detected portion) 65 within a predetermined time period (step 115), the control circuit determines that the wire reel 30 is not rotated and causes light emission from the LED or the like provided on the side surface of the reinforcing bar binder 1 or warning-sound generation (step 116).

After the detection of the amount of rotation of the wire reel 30, when no mark 53 has been detected during the amount of rotation (step 117) or when the number of marks 53 which have been detected during the amount of rotation is equal to or more than a predetermined value, for example, three (step 118), the control circuit causes light emission from the LED or the like provided on the side surface of the reinforcing bar binder 1 or warning-sound generation (step 119, step 120). The control circuit identifies the type of the wire reel 30 on the basis of the number of the detected marks 53 and sets the amount of feeding of the wire 8 depending on the number of rotations (the angle of rotation) of the wire feeding gear 17 and the twisting torque depending on the electric power supplied to the electric motor 9. For example, when the number of detected mark 53 is one (step 121), the control circuit sets an amount A of feeding of the wire 8 and a twisting torque A on the wire 8 (step 122). Further, when the number of detected marks 53 is two (step 123), the control circuit sets an amount B of feeding of the wire 8 and a twisting torque B on the wire 8 (step 124).

The aforementioned detection is rapidly performed and the wire 8 is fed forward along the guide portion 15 without causing interruption of the wire 8. After the identification of the type of the wire reel 30, the marks 53 or the protrusions 65 serve as a reel rotation detecting means and the marks 53 or the protrusions 65 start the detection of rotation of the wire reel (step 125). The elapsed time T1 since a mark 53 or a protrusion 65 was detected last until the next mark 53 or protrusion 65 is detected is longer than an error determination time period T2 (a set time period) (step 126), the control circuit determines that the wire reel 30 is not rotated and causes light emission from the LED or the like provided on the side surface of the reinforcing bar binder 1 or warning-sound generation (step 127).

When the aforementioned T1 is shorter than T2 (step 126), the wire 8 is fed by the amount set depending on the type of the wire reel 30 and wound around the reinforcing bar 3 in a loop shape. When the amount of wire which has been fed does not reach the set amount of feeding A or B (step 128), the process returns to the step 126. When the amount of the wire 8 which has been fed reaches the set amount of feeding A or B (step 128), the feeding of the wire is terminated (step 129) and the wire is cut. Thereafter, the wire is twisted by the twisting torque A or B of the electric motor 9 which has been set depending on the type of the wire reel 30 and thus the reinforcing bar 3 is bound (step 130). Consequently, the reinforcing bar binder 1 can automatically adjust the amount of feeding of the wire 8 or the twisting torque thereon in accordance with the thickness, characteristics and the like of the wire 8.

While in the aforementioned embodiment the two marks 53 (second to-be-detected portions) 53 are provided on the wire reel 30, it is obvious that a single, three or more marks may be provided thereon. Further, while the marks 53 are made of a while plastic, they may be reflective stickers. While the two protrusions (first to-be-detected portions) 65 are provided on the wire reel 30, it is obvious that a single, three or more protrusions may be provided thereon.

For example, in the event that the wire reel 30 is not normally set within the storing chamber 70 in the aforementioned reinforcing bar binder 1, when the first detecting means 80 is a non-contact type sensor such as an optical sensor, the first detecting means 80 may response to light other than the reflected light from the first to-be-detected portions of the wire reel 30 and to external disturbing light, and may detect it as normal rotation. However, the reinforcing bar binder 1 which has been described in the aforementioned embodiment employs a contact-type sensor as the first detecting means 80 and, therefore, even when the wire reel 30 is not normally set within the storing chamber 70, it will not detect the wire reel 30, thus enabling detection of the abnormal state.

Further, while the non-contact type sensor (optical sensor, interrupter) 25 for detecting the marks (second to-be-detected portions) 53 on the wire reel 30 is provided as the second detecting means within the storing chamber 70 of the binder main body 2, the second to-be-detected portions may be concave portions or convex portions instead of marks and the second detecting means may be contact sensors (switches) so that the type of the wire reel can be identified by the two contact sensors. Further, while the contact sensor (switch) 80 for detecting the protrusions (first to-be-detected portions) 65 on the wire reel 30 is provided as the first detecting means within the storing chamber 70 of the reinforcing main body 2, the first to-be-detected portions may be marks instead of convex portions and concave portions, and the first detecting means may be anon-contact type sensor (optical sensor, interrupter) so that the type of the wire reel 30 may be identified by the two non-contact type sensors.

EFFECTS OF THE INVENTION

With the reinforcing bar binder 1 according to the present invention, the amount of rotation of the wire reel is detected by the first detecting means and the number of the to-be-detected portions of the wire reel is detected by the second detecting means, thus providing the advantage that the type of the wire reel can be identified and the feeding amount of the wire wound around the wire reel or the twisting torque for the wire can be controlled. More specifically, the detection of the amount of rotation of the wire reel is performed by detecting the first to-be-detected portions on the wire reel with the first detecting means and, when the first to-be-detected portions are convex portions or concave portions, a contact-type sensor may be employed as the first detecting means, thus providing the advantage that the first to-be-detected portions can be certainly detected.

The wire reel used in the reinforcing bar binder according to the present invention includes the first to-be-detected portions which are detected by the first detecting means of the reinforcing bar binder and the second to-be-detected portions which are detected by the second detecting means of the reinforcing bar binder, wherein there are provided the advantages that the amount of rotation thereof is detected by detecting the first to-be-detected portions with the first detecting means and the type of the wire reel is detected by detecting the second to-be-detected portions with the second detecting means. More specifically, the first to-be-detected portions may be convex portions or concave portions which are detected by the contact type sensor and the second to-be-detected portions may be marks which are detected by the non-contact type sensor, which provides the advantage that the type of the wire reel can be certainly identified. Further, there is provided the advantage that a user can identify the type of the wire reel only by looking the aspect of the second to-be-detected portions (for example, the number of marks) on the wire reel.

The method for identifying a wire reel used in the reinforcing bar binder according to the present invention detects the amount of rotation of the wire reel and detects the number of to-be-detected portions provided on the wire reel during the detected amount of rotation of the wire reel, thus providing the advantage that there is no need for the wire-reel rotation speed and the wire-reel operating time as the factors for identifying the wire reel. Consequently, even if the wire reel rotates at a significantly high or low speed, it is possible to identify the wire reel. Further, there is no need for detecting the number of the to-be-detected portions within a driving time period of the wire-reel, and therefore it is possible to perform certain identification. By identifying the type of the wire reel, it is possible to automatically adjust the amount of feeding of the wire or the twisting torque for the wire, thus providing the advantage that manual adjustments are unnecessary.

DESCRIPTION OF REFERENCE NUMERALS

1; reinforcing bar binder, 2; binder main body, 3; reinforcing bar, 5; abutting plate portions, 6; wire-inserting groove, 7; twisting hook, 8; wire, 9; electric motor, 10; forward/backward moving mechanism, 11; trigger, 12; wire path, 15; guide portion, 16; motor (feeding device), 17; gear (feeding device), 20; micro switch, 21; wire gripping/cutting means, 22; cover member, 23; reel mounting shaft, 24; reel stopper, 25; interrupter (second detecting means, non-contact sensor), 30; wire reel, 30*a*; reel main body, 31; hub portion, 32; flange, 33; flange, 34; engaging pawls, 35; wire-inserting opening, 36; wire-inserting hole, 40; inner cylinder, 41; one end, 42; other end, 43; side surface, 45; mounting hole, 46; side wall, 47; inner surface, 49; concave portion, 50; fixation shafts, 51; tip ends, 52; mounting holes, 53; marks (second to-be-detected portions), 55; mounting shaft, 56; reflection plate, 57; concave portion, 58; boss portion,

59; outer peripheral edge, 60; tapered surface, 61; inner peripheral edge, 62; step concave portion, 65; protrusions (first to-be-detected portions), 66; inclined edge, 67; boss portion, 68; hole, 70; storing chamber, 72; front wall, 73; bottom wall, 75; side wall, 76; protruding portion, 77; sensor placing hole, 78; opening, 80; switch (first detecting means, contact sensor), 81; supporting shaft, 82; swayable member, 83; contact piece, 85; elastic member, 86; magnet portion, 87; Hall IC, 89; elastic piece, 90; opening

INDUSTRIAL APPLICABILITY

The present invention is applicable to a reinforcing bar binder and a wire reel used therewith.

The invention claimed is:

1. A wire reel utilized in a reinforcing bar binder comprising a control circuit and a storing chamber provided in a main body of the reinforcing bar binder for mounting the wire reel around which a wire for binding a reinforcing-bar is wound, the wire being twisted for binding the reinforcing bar after it is wound around the reinforcing bar, wherein the storing chamber is provided with a first detecting apparatus and a second detecting apparatus;

the wire reel is provided with a first to-be-detected portion and a second to-be-detected portion coupled to the control circuit;

the first to-be-detected portion is detected by the first detecting apparatus to detect an amount of rotation of the wire reel; and the second to-be-detected portion passing the second detecting apparatus during the amount of rotation of the wire reel detected by the first detecting apparatus is counted by the control circuit, wherein the wire reel is provided with a flange and a round concave portion formed on a central portion of the flange, and the first to-be-detected portion is formed on the flange and the second to-be-detected portion is housed within the round concave portion.

2. The wire reel according to claim 1, wherein the first detecting apparatus is a contact-type sensor and the second detecting apparatus is a non-contact type sensor.

3. A wire-reel identifying method utilized with a reinforcing bar binder comprising a storing chamber provided in a main body of the reinforcing bar binder for mounting a wire reel around which a wire for binding a reinforcing-bar is wound, the wire being fed by rotating the wire reel and being twisted for binding the reinforcing bar after it is wound around the reinforcing bar, the method comprising:

counting, during an amount of rotation of the wire reel detected by a first detecting apparatus for detecting a first to-be-detected portion, a second to-be-detected portion provided on the wire reel and passing a second detecting apparatus;

providing with the wire reel a flange and a round concave portion formed on a central portion of the flange; and forming the first to-be-detected portion on the flange and housing the second to-be-detected portion within the round concave portion.

4. The wire-reel identifying method according to claim 3, wherein the first detecting apparatus is a contact-type sensor and the second detecting apparatus is a non-contact type sensor.

5. A wire-reel identifying method comprising:

providing a first to-be-detected portion and a second to-be-detected portion on a wire reel;

detecting the first to-be-detected portion with a first detecting apparatus to detect an amount of rotation of the wire reel;

detecting the second to-be-detected portion with a second detecting apparatus during rotation of the wire reel;

counting with a control circuit the second to-be-detected portion detected with the second detecting apparatus to detect a type of the wire reel;

providing with the wire reel a flange and a round concave portion formed on a central portion of the flange; and forming the first to-be-detected portion on the flange and housing the second to-be-detected portion within the round concave portion.

6. A wire reel utilized in a reinforcing bar binder comprising a control circuit and a storing chamber provided in a main body of the reinforcing bar binder for mounting the wire reel around which a wire for binding a reinforcing-bar is wound, the wire being twisted for binding the reinforcing bar after it is wound around the reinforcing bar, wherein the storing chamber is provided with a first detecting apparatus and a second detecting apparatus;

the wire reel is provided with a first to-be-detected portion and a second to-be-detected portion coupled to the control circuit;

the first to-be-detected portion is detected by the first detecting apparatus to detect an amount of rotation of the wire reel; and the second to-be-detected portion passing the second detecting apparatus during the amount of rotation of the wire reel detected by the first detecting apparatus is counted by the control circuit, wherein the wire reel further comprises:

a pair of flanges for receiving the wire therebetween; and a boss portion formed on one of the flanges, wherein the first to-be-detected portion is formed outside the boss portion and the second to-be-detected portion is formed inside the boss portion.

7. The wire reel according to claim 6, wherein the boss portion surrounds a round concave portion formed in a hub portion of the wire reel, and the round concave portion houses at least one fixation shaft having a light reflecting mark forming the second to-be-detected portion.

8. The wire reel according to claim 7, wherein the boss portion has a stepped concave portion at an inner peripheral edge, and the stepped concave portion has a depth which substantially reaches the light reflecting mark provided on the fixation shaft.

9. The wire reel according to claim 6, wherein the first to-be-detected portion is formed by a protrusion on an outer peripheral edge of the boss portion.

10. The wire reel according to claim 9, wherein the protrusion is formed to have a trapezoid shape and includes inclined edges at its opposite sides.

* * * * *